US009914241B2

(12) United States Patent
Tian et al.

(10) Patent No.: US 9,914,241 B2
(45) Date of Patent: Mar. 13, 2018

(54) BATCH-STYLE BOTTOM-DISCHARGE ROTARY DEBARKER

(71) Applicant: Acrowood Corporation, Everett, WA (US)

(72) Inventors: Jun Tian, Everett, WA (US); Benjamin Yen, Seattle, WA (US)

(73) Assignee: Acrowood Corporation, Everett, WA (US)

( * ) Notice: Subject to any disclaimer, the term of this patent is extended or adjusted under 35 U.S.C. 154(b) by 219 days.

(21) Appl. No.: 15/005,920

(22) Filed: Jan. 25, 2016

(65) Prior Publication Data

US 2016/0214271 A1 Jul. 28, 2016

Related U.S. Application Data

(60) Provisional application No. 62/107,965, filed on Jan. 26, 2015, provisional application No. 62/153,390, filed on Apr. 27, 2015.

(51) Int. Cl.

| | |
|---|---|
| ***B27L 1/00*** | (2006.01) |
| ***B27L 1/02*** | (2006.01) |
| ***B27L 1/10*** | (2006.01) |
| ***B27L 1/04*** | (2006.01) |
| ***B27L 1/05*** | (2006.01) |

(52) U.S. Cl.

CPC *B27L 1/02* (2013.01); *B27L 1/04* (2013.01); *B27L 1/05* (2013.01); *B27L 1/10* (2013.01)

(58) Field of Classification Search

CPC ..... B27L 1/00; B27L 1/02; B27L 1/04; B27L 1/05; B27L 1/08; B27L 1/10; B27L 1/12; B27L 1/127

See application file for complete search history.

(56) References Cited

U.S. PATENT DOCUMENTS

| | | | |
|---|---|---|---|
| 1,281,155 | A | 10/1918 | Guettler |
| 2,137,452 | A | 11/1938 | Hillbom |
| 2,647,548 | A | 8/1953 | Guettler |
| 2,741,283 | A | 4/1956 | Alexander |
| 3,215,176 | A | 11/1965 | Ferrabee |
| 3,228,440 | A | 1/1966 | Ferrabee |
| 3,489,190 | A | 1/1970 | Voronitsyn et al. |
| 4,691,750 | A | 9/1987 | Nakajima |

(Continued)

FOREIGN PATENT DOCUMENTS

| | | |
|---|---|---|
| CA | 2106950 C | 3/1995 |
| CA | 2419762 C | 5/2012 |
| SE | 158 984 C1 | 5/1957 |

OTHER PUBLICATIONS

Brunette Industries Ltd., "Brunette Reclaimer Rotary Debarker" Promotional Brochure, published at least as early as Jan. 25, 2015, 4 pages.

*Primary Examiner* — Matthew G Katcoff

(74) *Attorney, Agent, or Firm* — Seed IP Law Group LLP

(57) ABSTRACT

Disclosed herein are embodiments of batch-style bottom-discharge rotary debarkers for removing bark from a batch of logs in a bin and discharging debarked logs from a bottom of the bin. In some embodiments, the bin includes four walls and an opening in its bottom. In some embodiments, the debarkers include a plurality of rotors, a plurality of chutes, and a plurality of conveyor belt systems for carrying bark and logs away from the bin. In some embodiments, the debarkers include an internal gate which can be moved between a debarking configuration and an unloading configuration.

15 Claims, 19 Drawing Sheets

(56) References Cited

U.S. PATENT DOCUMENTS

| | | | |
|---|---|---|---|
| 5,083,897 | A | 1/1992 | Hand et al. |
| 5,263,522 | A | 11/1993 | Sasko |
| 5,394,912 | A | 3/1995 | Hume |
| 5,630,453 | A | 5/1997 | Ishizawa |
| 5,673,865 | A | 10/1997 | Stroulger |
| 6,588,467 | B2 | 7/2003 | Havumaki et al. |
| 6,615,884 | B2 | 9/2003 | Havumaki et al. |
| 6,941,988 | B2 | 9/2005 | Peetso et al. |
| 8,201,599 | B2 | 6/2012 | Kokko |

BATCH-STYLE BOTTOM-DISCHARGE ROTARY DEBARKER

BACKGROUND

Technical Field

This disclosure relates to rotary debarkers and related methods of removing bark from logs.

Description of the Related Art

Removing bark from (debarking) logs can be accomplished using various debarking systems and various debarking techniques. For example, ring debarkers can include a ring of cutting tools through which logs can pass, one at a time, to be debarked. As another example, drum debarkers can include a rotating inclined drum which can be filled with a plurality of logs to be debarked. The logs can be debarked as the drum rotates and causes the logs to impact and rub against one another and to impact and rub against the drum. The logs can slide through the inclined drum from an upper entrance of the drum to a lower outlet of the drum.

Other debarking systems include rotary debarkers, which can include a drum or bin having a plurality of rollers along its bottom. Logs can be fed into the bin and the rollers can be actuated to rotate, causing the logs to impact and rub against one another and to impact and rub against the rollers, thereby being debarked. There remains room for improvement, however, such as in efficiency, in debarking systems such as rotary debarking systems.

BRIEF SUMMARY

In some embodiments, a debarking system includes a bin including a first side wall, a first end wall, a second side wall opposite the first side wall, a second end wall opposite the first end wall, and an opening in a bottom of the bin, a plurality of rotors, each of the plurality of rotors aligned with the first side wall, aligned with the second side wall, and spanning from the first end wall to the second end wall, and an internal gate movable from a debarking configuration, in which the internal gate obstructs access to the opening to prevent a log in the bin from falling out of the bin through the opening, to an unloading configuration, in which the internal gate is spaced apart from the debarking configuration to provide access to the opening and to allow the log to fall out of the bin through the opening.

In other embodiments, a debarking system includes a bin including a first side wall, a first end wall, a second side wall opposite the first side wall, a second end wall opposite the first end wall, and an opening in a bottom of the bin, a plurality of rotors, each of the plurality of rotors aligned with the first side wall, aligned with the second side wall, and spanning from the first end wall to the second end wall, a bark chute having an upper opening directly under the plurality of rotors and a lower opening directly over a first conveyor belt system, a log chute having an upper opening directly under a gap between the plurality of rotors and the first side wall, and a lower opening directly over a second conveyor belt system, and an internal gate rotatable from a debarking configuration, in which the internal gate prevents a log in the bin from falling out of the bin, to an unloading configuration, in which the internal gate allows the log to fall out of the bin.

DETAILED DESCRIPTION

Figure 1:
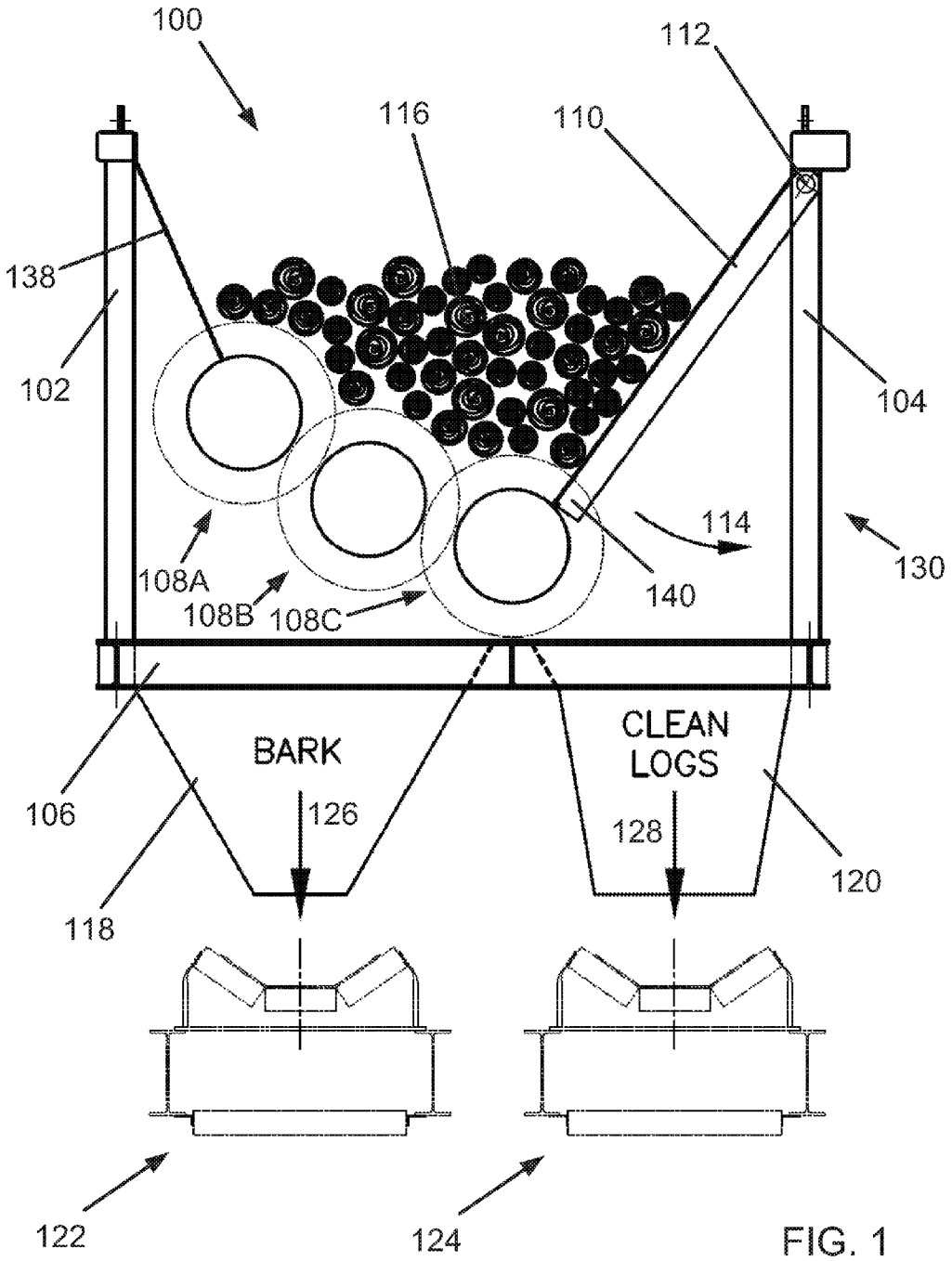
FIG. 1 illustrates a cross-sectional end view, taken along line A-A in FIG. 3, of a batch-style bottom-discharge rotary debarker, as it debarks logs, according to at least one illustrated embodiment.
Figure 2:
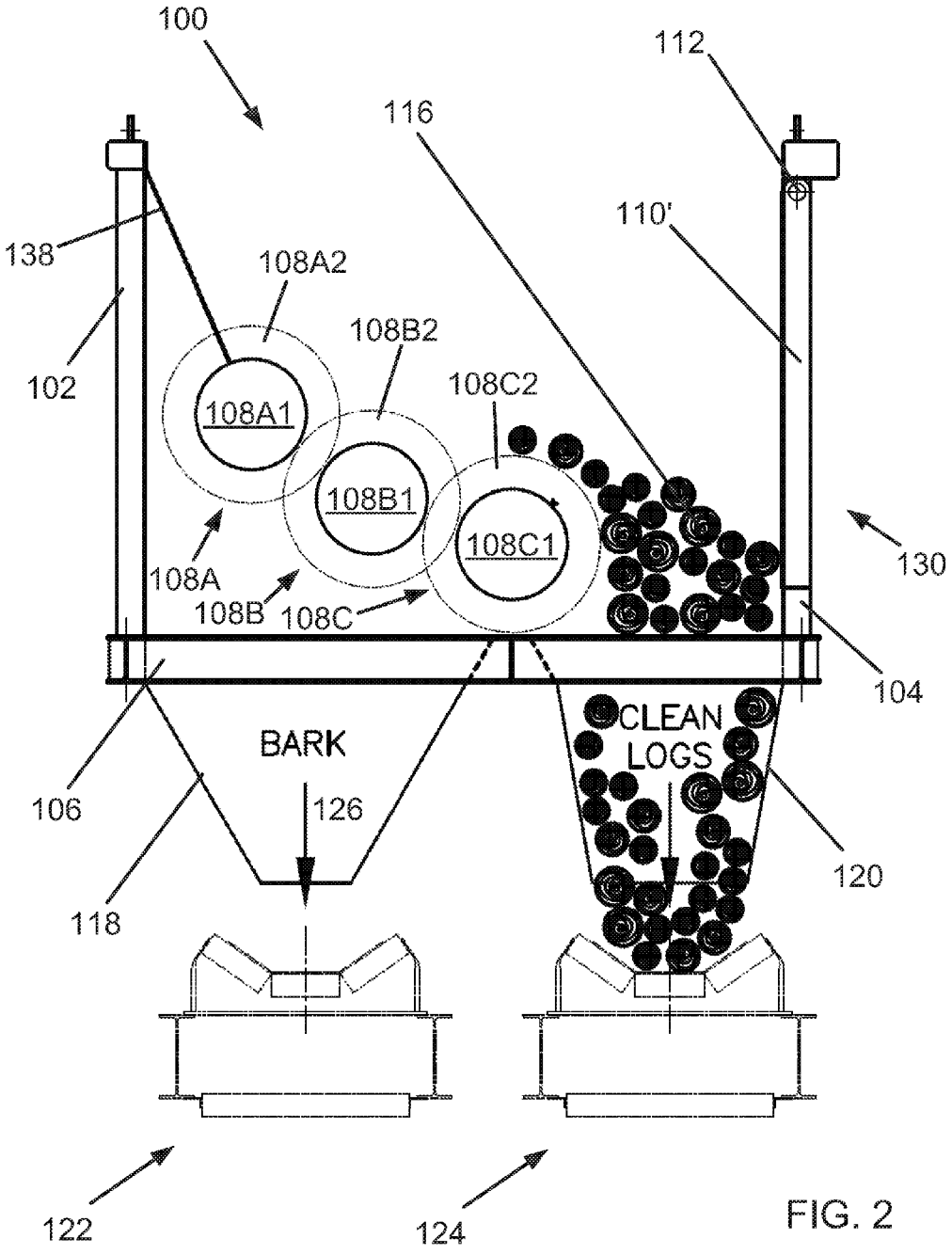
FIG. 2 illustrates a cross-sectional end view, taken along line A-A in FIG. 3, of the batch-style bottom-discharge rotary debarker of FIG. 1, as it discharges logs, according to at least one illustrated embodiment.
Figure 3:
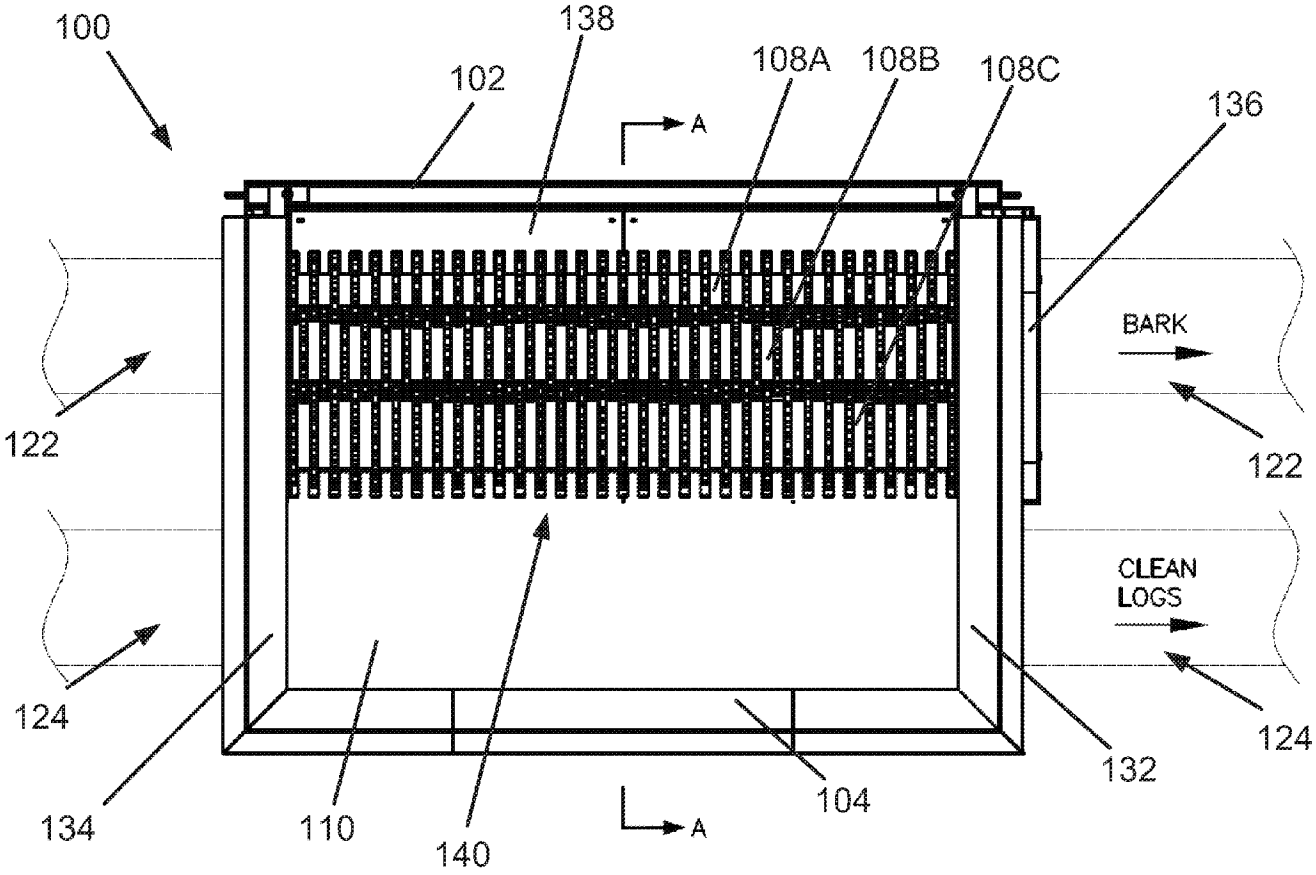
FIG. 3 illustrates a top view of the batch-style bottom-discharge rotary debarker of FIGS. 1 and 2 according to at least one illustrated embodiment.

FIGS. 1-3 illustrate an example of a batch-style bottom-discharge rotary debarker 100 including a bin 130, a first conveyor belt system 122, and a second conveyor belt system 124. The bin 130 is positioned above the first conveyor belt system 122 and the second conveyor belt system 124. As used herein, the terms "above" and "below," "top" and "bottom," and other similar terms are intended to convey their ordinary meaning and are used to describe the relative positions of elements, for example, such that gravity pulls an item from a first location above a second location toward the second location.

The bin 130 includes a first external side wall 102, a second external side wall 104, a first external end wall 132, and a second external end wall 134. Together, the side and end walls 102, 104, 132, 134 can form the four walls of the bin 130, which can have a rectangular cross-sectional shape. The bin 130 can include a rectangular bottom frame 106, which can be open at its center such that logs, bark, and other debris can fall out of the bin through the bottom frame 106.

The debarker 100 can also include a plurality of rotors 108A, 108B, 108C (collectively, 108) mounted inside the bin, such as on rotor support elements 136. The rotor support elements 136 can include bearings and other features to allow the rotors 108 to rotate smoothly, as well as power sources or power transmission elements to drive rotation of the rotors 108. The rotors 108 can span a length of the bin 130, extending from the first end wall 132 to the second end wall 134, and having central longitudinal axes aligned with or parallel to the first and second side walls 102, 104. Each of the rotors 108 can include a solid central core 108A1, 108B1, and 108C1, from which a plurality of radially extending circumferential blades, or protrusions 108A2, 108B2, and 108C2 extend. As shown in FIG. 2, the protrusions 108A2 of the rotor 108A can mesh with the protrusions 108B2 of the rotor 108B, and the protrusions 108B2 of the rotor 108B can mesh with the protrusions 108C2 of the rotor 108C, so that logs being debarked within the debarker 100 cannot fit between the rotors 108.

The debarker 100 can include a finger plate 138 coupled to and extending into the bin 130 away from the first side wall 102, and can have a plurality of fingers that mesh with the protrusions 108A2 of the rotor 108A, so that logs being debarked within the debarker 100 cannot fit between the wall 102 and the rotor 108A. The rotors 108 can be arranged such that the rotor 108A is closer to the top of the bin 130 than the rotor 108B, and such that the rotor 108B is closer to the top of the bin 130 than the rotor 108C, such that the rotors 108 form a generally inclined floor extending out and down from the first side wall 102 toward the second side wall 104.

A gap or space can be provided between the rotor 108C and the second side wall 104, for example, such that the inclined floor formed by the rotors 108 does not reach the second side wall 104. A rotatable, internal gate 110 can be rotatably coupled to the end walls 132, 134, and/or to the second side wall 104 such that the internal gate 110 can rotate with respect to the second side wall 104, such as at a hinge 112 located at and coupled to a top end portion of the second side wall 104, such that a top end portion of the internal gate 110 is rotatably coupled to the top end portion of the second side wall 104. A bottom end portion of the internal gate 110, i.e., the portion of the internal gate 110 farthest from the hinge 112 and opposite the top end portion of the internal gate 110, can include a plurality of fingers forming a finger plate 140 extending away from the hinge 112.

The bottom frame 106 can be coupled to a bark chute 118 and to a log chute 120. The bark chute 118 can have an upper opening positioned to collect objects such as bark or other debris falling between the rotors 108, a lower opening positioned to drop the objects onto the first conveyor belt system 122, and a main body configured to guide the objects from the upper opening to the lower opening. The log chute 120 can have an upper opening positioned to collect logs falling out of the bin 130, a lower opening positioned to drop the logs onto the second conveyor belt system 124, and a main body configured to guide the logs from the upper opening to the lower opening. Together, the bark chute 118 and the log chute 120 can be positioned to collect all objects falling out of the bin through the opening in the bottom frame 106.

The rotor 108C can be positioned directly above a location where an edge of the bark chute 118 meets an edge of the log chute 120, and thus can function as a divider to separate bark and other debris from debarked logs. For example, the locations of the bark chute 118, log chute 120, rotors 108, and internal gate 110 can ensure that bark and other debris fall out of the bin 130 into the bark chute 118 (e.g., between the rotors 108, which can be positioned directly above the bark chute 118), and that logs fall out of the bin 130 into the log chute 120 (e.g., through the gap or space between the rotor 108C and the second side wall 104, which can be positioned directly above the log chute 120). In some cases, the bark chute 118 can be directly over the first conveyor belt system 122 and the log chute 120 can be directly over the second conveyor belt system 124.

In operation of the debarker 100, the internal gate 110 can be rotated about the hinge 112 to a debarking configuration, as shown in FIG. 1, such that the finger plate 140 of the internal gate 110 meshes with the protrusions 108C2 of the rotor 108C. A plurality of logs 116 can be deposited into the bin 130 and the rotors 108 can be actuated to rotate. As the rotors 108 rotate under the logs 116, the rotors 108 can impact and rub against the logs 116, thereby debarking the logs 116 and moving the logs 116 within the bin 130. Movement of the logs 116 within the bin 130 can cause the logs 116 to impact and rub against one another, further debarking the logs 116. Bark and other debris removed from the logs 116 can fall between the rotors 108, through the bark chute 118, and onto the first conveyor belt system 122, as shown by arrow 126. The first conveyor belt system 122 can carry the bark and other debris away from the debarker 100.

In some cases, while the internal gate 110 is in the debarking configuration and during debarking of the logs 116, the rotors 108 can be rotated counter-clockwise as viewed from the cross-sectional end view of FIG. 1. In such cases, the logs can be carried upwards along the inclined floor from the rotor 108C to the rotor 108A, then upwards along the finger plate 138, then across the top of the logs 116, then down along the internal gate 110 back to the rotor 108C. Thus, the rotors 108 can cause the logs 116 to travel in a generally clockwise path, as viewed from the cross-sectional end view of FIG. 1, through the bin 130. In other cases, the rotors 108 can be rotated clockwise. In such cases, the logs can be carried downwards along the inclined floor from the rotor 108A to the rotor 108C, then upwards along the internal gate 110, then across the top of the logs 116, then down along the finger plate 138 back to the rotor 108A. Thus, the rotors 108 can cause the logs 116 to travel in a generally counter-clockwise path, as viewed from the cross-sectional end view of FIG. 1, through the bin 130.

Once the logs 116 have been sufficiently debarked, for example, in accordance with an operator inspection of the logs or after the logs 116 have been debarked for a certain period of time, the internal gate 110 can be rotated about the hinge 112 to an unloading configuration, as shown by arrow 114 in FIG. 1 and as shown in FIG. 2, such that the finger plate 140 of the internal gate 110 no longer meshes with the protrusions 108C2 of the rotor 108C. In the Figures, internal gates in the debarking configuration are indicated by a reference numeral without an apostrophe (e.g., 110) and internal gates in the unloading configuration are indicated by a reference numeral with an apostrophe (e.g., 110'). As shown in FIG. 2, the hinge 112 can be situated in the plane of the second side wall 104 and the internal gate 110 can be situated within the plane of the second side wall 104 in the unloading configuration. The second side wall 104 can have an opening to accommodate the hinge 112 and/or the internal gate 110 in this configuration.

The logs 116 can then fall through the gap or space between the rotor 108C and the second side wall 104, through the opening at the center of the bottom frame 106, out of the bin 130 through the log chute 120, and onto the second conveyor belt system 124, as shown by arrow 128. Allowing the logs 116 to fall out of the bin 130 onto the second conveyor belt system 124 can allow the logs 116 to be discharged from the bin 130 more quickly than if the logs 116 were discharged from a side or an end of a debarker. The second conveyor belt system 124 can carry the logs 116 away from the debarker 100. As shown in FIG. 3, the first conveyor belt system 122 can carry the bark and other debris away from the debarker 100 in the same direction the second conveyor belt system 124 carries the logs 116 away from the debarker 100. In alternative embodiments, the first conveyor belt system 122 can carry the bark and other debris away from the debarker 100 in a direction opposite to the direction the second conveyor belt system 124 carries the logs 116 away from the debarker 100.

The first conveyor belt system 122 can carry the bark and other debris away from the debarker 100 in a direction aligned with or parallel to central longitudinal axes of the logs 116 while the logs 116 are in the bin 130, as viewed from the cross-sectional end view of FIG. 1. Similarly, the second conveyor belt system 124 can carry the logs 116 away from the debarker 100 in a direction aligned with or parallel to central longitudinal axes of the logs 116 while the logs 116 are in the bin 130, as viewed from the cross-sectional end view of FIG. 1. The first conveyor belt system 122 and the second conveyor belt system 124 can be directly under the bin 130 and aligned with the axes of the logs 116 while the logs 116 are in the bin 130. Thus, the logs 116 can fall vertically out of the bin 130 through the log chute 120 directly onto the second conveyor belt system 124, which can carry the logs 116 away from the debarker 100 in a direction aligned with the central longitudinal axes of the logs 116.

In some cases, the internal gate 110 can be rotated about the hinge 112 partially toward the unloading configuration, so as to control a size of an opening through which the logs 116 can fall out of the bin 130. In this way, the rate at which the logs 116 fall out of the bin 130 and onto the second conveyor belt system 124 can be controlled (i.e., the logs can be metered), so as to produce a consistent flow of logs along the second conveyor belt system 124 to a next log processing apparatus, such as a chipper. In some cases, a size of the lower opening of the log chute 120 can be selected to meter or control the rate of passage of the logs 116 through the log chute 120.

In some cases, the rotation of the rotors 108 can be stopped during such unloading of the bin 130. In other cases in which the rotors 108 were rotating clockwise during debarking of the logs 116, the rotors 108 can continue to rotate clockwise during unloading of the logs 116 from the bin 130, so as to assist in unloading the logs 116 from the bin 130. In other cases in which the rotors 108 were rotating counter-clockwise during debarking of the logs 116, the rotors 108 can be actuated to rotate clockwise during unloading of the logs 116 from the bin 130, so as to assist in unloading the logs 116 from the bin 130. In cases in which the rotors 108 are rotated to assist unloading the logs 116 from the bin 130, a speed of rotation of the rotors 108 can be controlled to further control the rate at which the logs 116 are unloaded from the bin 130.

FIGS. 1-3 illustrate one embodiment of a batch-style bottom-discharge rotary debarker. Other embodiments and configurations are possible and within the scope of this disclosure. For example, in some implementations, a rotatable internal gate can be coupled to a bin of a debarker by a hinge at a location lower than the rotors of the debarker. In other implementations, rotors of a debarker can be rotatably coupled to a bin of the debarker, such that the rotors can be rotated with respect to the bin, as described above with respect to the internal gate 110, to allow logs to fall out of the bin. Further examples are described below.

Figure 4:
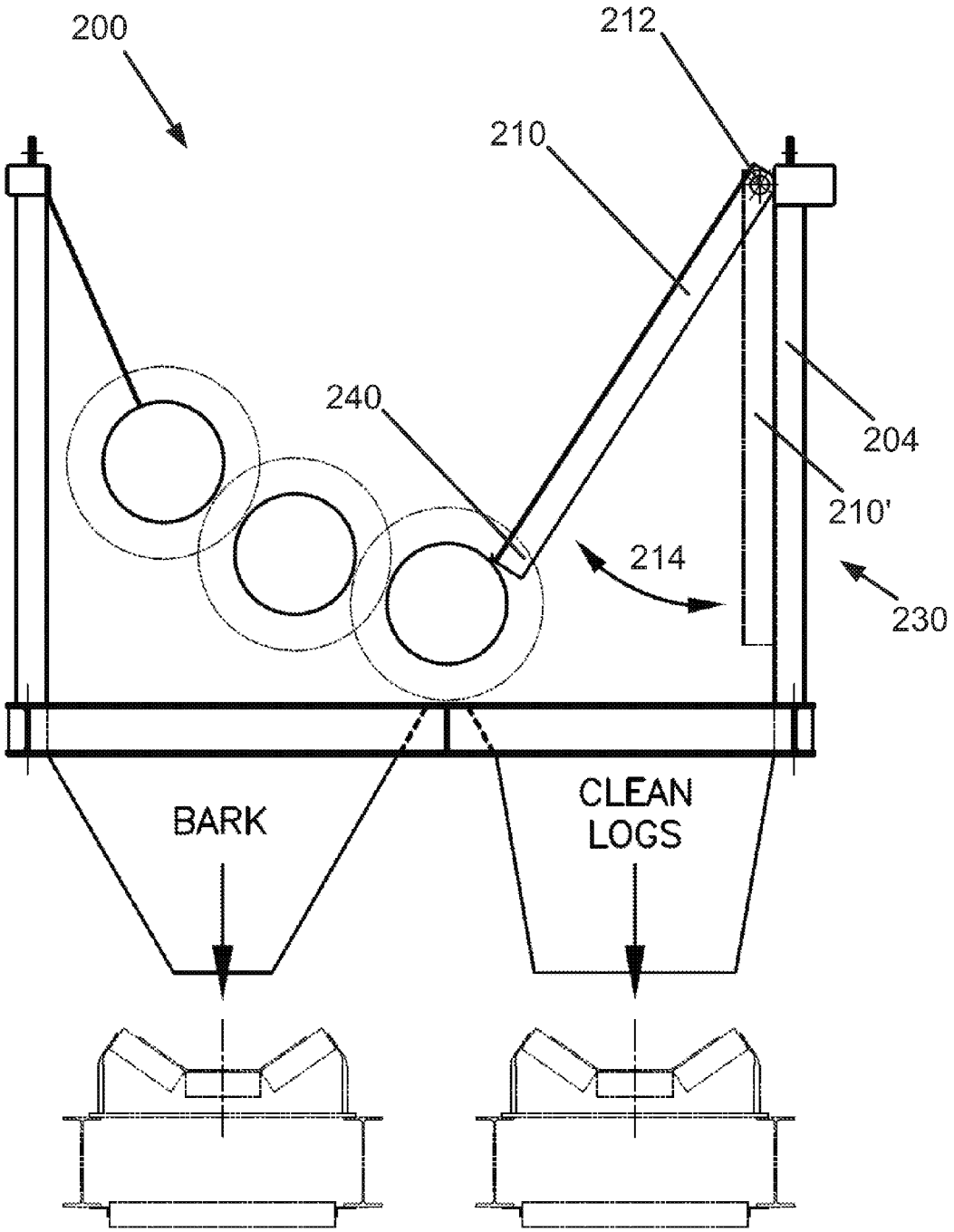
FIG. 4 illustrates a cross-sectional end view of another batch-style bottom-discharge rotary debarker according to at least one illustrated embodiment.

FIG. 4 illustrates another example of a batch-style bottom-discharge rotary debarker 200 similar to rotary debarker 100. Debarker 200 includes a bin 230 similar to bin 130 and an external side wall 204 similar to the external side wall 104. Debarker 200 also includes a rotatable, internal gate 210 rotatably coupled to end walls (not shown) of the bin 230 and/or to an interior surface of the external side wall 204. The internal gate 210 can rotate with respect to the external side wall 204, such as at a hinge 212 located adjacent to and coupled to a top end portion of the external side wall 204. In this example, a top end portion of the internal gate 210 is rotatably coupled to a top end portion of the external side wall 204. Further, a bottom end portion of the internal gate 210, i.e., the portion of the internal gate 210 farthest from the hinge 212 and opposite the top end portion of the internal gate 210, can include a plurality of fingers forming a finger plate 240 extending away from the hinge 212. The external side wall 204 can be provided without an opening to accommodate the hinge 212 and/or the internal gate 210 in this configuration.

Operation of the debarker 200 can proceed similarly to operation of the debarker 100. The internal gate 210 can be rotated about the hinge 212 between a debarking configuration and an unloading configuration, as shown by arrow 214.

Figure 5:
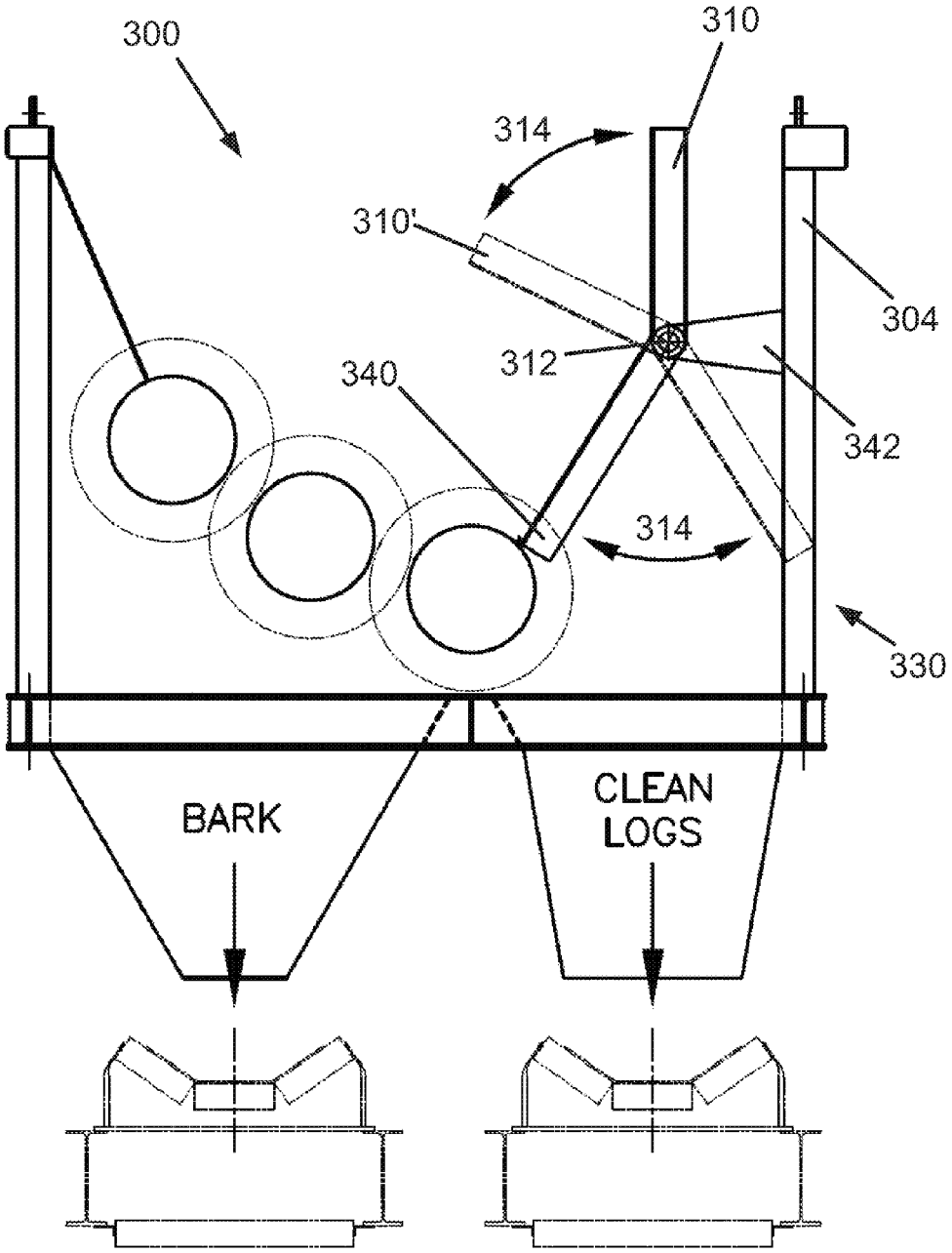
FIG. 5 illustrates a cross-sectional end view of another batch-style bottom-discharge rotary debarker according to at least one illustrated embodiment.

FIG. 5 illustrates another example of a batch-style bottom-discharge rotary debarker 300 similar to rotary debarker 100. Debarker 300 includes a bin 330 similar to bin 130 and an external side wall 304 similar to the external side wall 104. Debarker 300 also includes a rotatable, internal gate 310 rotatably coupled to end walls (not shown) of the bin 330 and/or to an interior surface of the external side wall 304. The internal gate 310 can rotate with respect to the external side wall 304, such as at a hinge 312 coupled to a mount 342 which is coupled to the interior surface of the external side wall 304. The mount 342 can be coupled to the external side wall 304 between a top end portion and a bottom end portion of the external side wall 304, such as at about the middle of the external side wall 304, or at a location closer to the top end portion than to the bottom end portion of the external side wall 304.

In this example, the internal gate 310 is angled or bent at a bend location at a middle portion of the internal gate 310 located between a top end portion and a bottom end portion of the internal gate 310, and the internal gate 310 is rotatably coupled to the hinge 312 at the bend location. The internal gate 310 is angled or bent so as to form an angle less than 180° facing the interior of the bin 330 and the rotors of the debarker 300. Further, a bottom end portion of the internal gate 310 can include a plurality of fingers forming a finger plate 340 extending away from the hinge 312. The external side wall 304 can be provided with an opening to accommodate a portion of the internal gate 310 in this configuration.

Operation of the debarker 300 can proceed similarly to operation of the debarker 100. The internal gate 310 can be rotated about the hinge 312 between a debarking configuration and an unloading configuration, as shown by arrows 314.

Figure 6:
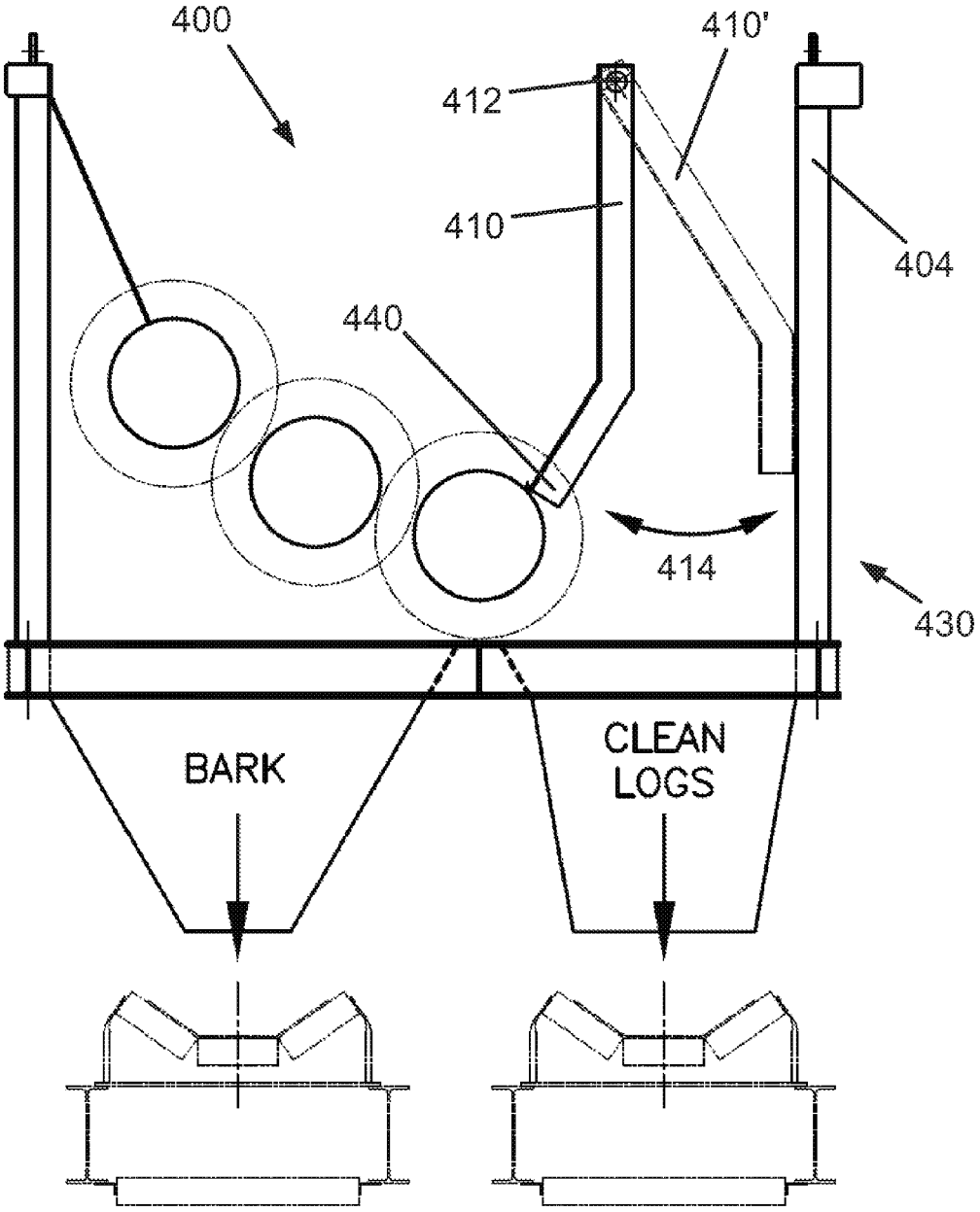
FIG. 6 illustrates a cross-sectional end view of another batch-style bottom-discharge rotary debarker according to at least one illustrated embodiment.

FIG. 6 illustrates another example of a batch-style bottom-discharge rotary debarker 400 similar to rotary debarker 100. Debarker 400 includes a bin 430 similar to bin 130 and an external side wall 404 similar to the external side wall 104. Debarker 400 also includes a rotatable, internal gate 410 coupled to end walls (not shown) of the bin 430. The internal gate 410 can rotate with respect to the external side wall 404, such as at a hinge 412 mounted to the end walls of the bin 430.

In this example, the internal gate 410 is angled or bent at a bend location at a middle portion of the internal gate 410 located between a top end portion and a bottom end portion of the internal gate 410, and the internal gate 410 is rotatably coupled to the hinge 412 at its top end portion. The internal gate 410 is angled or bent so as to form an angle less than 180° facing the interior of the bin 430 and the rotors of the debarker 400. Further, the bottom end portion of the internal gate 410 can include a plurality of fingers forming a finger plate 440. The external side wall 304 can be provided without an opening to accommodate the hinge 412 and/or the internal gate 410 in this configuration.

Operation of the debarker 400 can proceed similarly to operation of the debarker 100. The internal gate 410 can be rotated about the hinge 412 between a debarking configuration and an unloading configuration, as shown by arrow 414. The internal gate 410 can be angled or bent such that when the internal gate 410 is in the unloading configuration, the bottom end portion of the internal gate 410 lies flush against the external side wall 404. The hinge 412 can be separated from the external side wall 404 by a distance to allow the internal gate 410 to swing from the debarking configuration to the unloading configuration.

Figure 7:
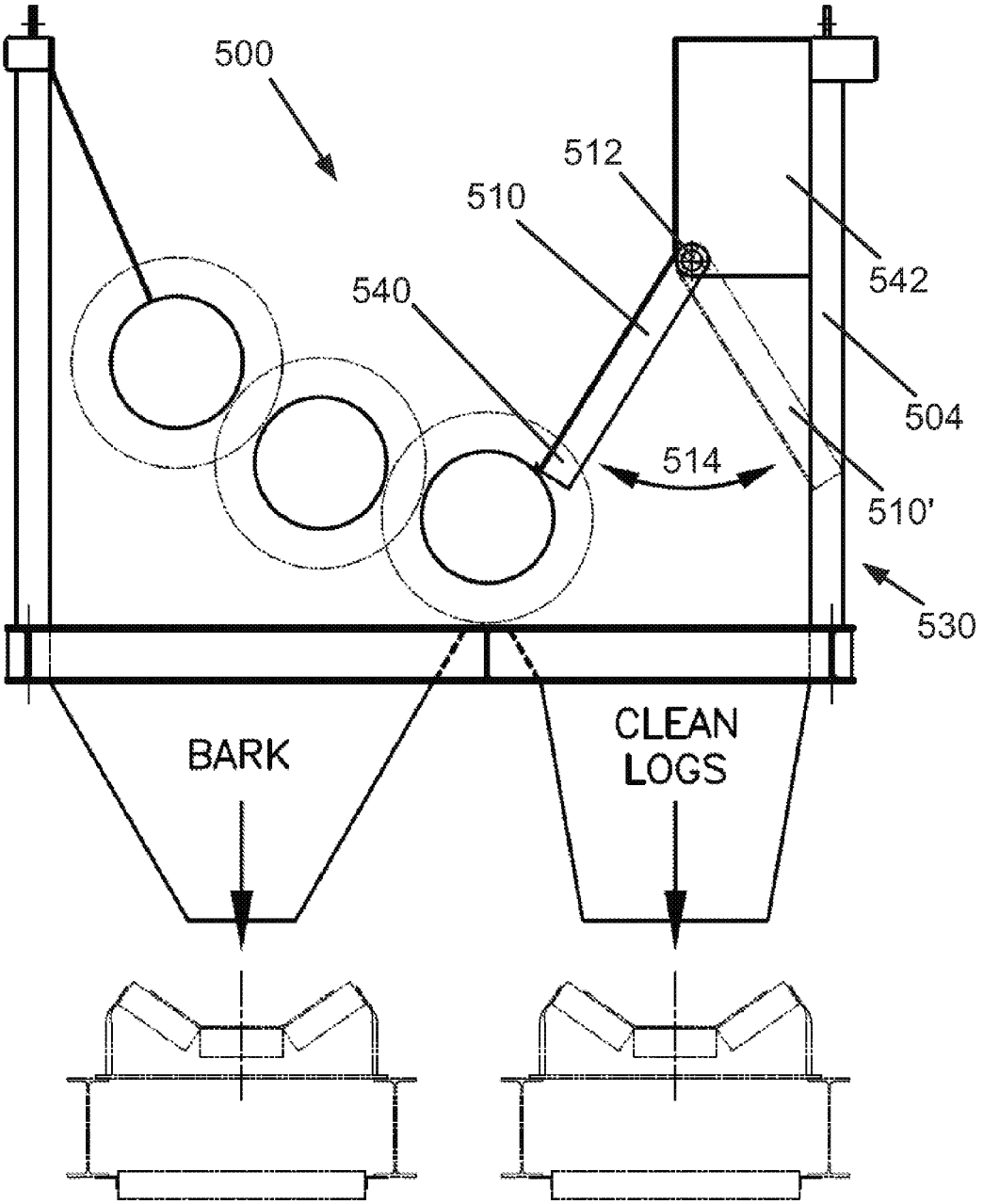
FIG. 7 illustrates a cross-sectional end view of another batch-style bottom-discharge rotary debarker according to at least one illustrated embodiment.

FIG. 7 illustrates another example of a batch-style bottom-discharge rotary debarker 500 similar to rotary debarker 100. Debarker 500 includes a bin 530 similar to bin 130 and an external side wall 504 similar to the external side wall 104. Debarker 500 also includes a rotatable, internal gate 510 rotatably coupled to end walls (not shown) of the bin 530 and/or to an interior surface of the external side wall 504. The internal gate 510 can rotate with respect to the external side wall 504, such as at a hinge 512 coupled to a mount 542 coupled to the interior surface of the external side wall 504. The mount 542 can be coupled to the external side wall 504 between a top end portion and a bottom end portion of the external side wall 504, such as at about the middle of the external side wall, or at a location closer to the top end portion than to the bottom end portion of the external side wall 504, or at the top end portion of the external side wall 504. A bottom end portion of the internal gate 510 can include a plurality of fingers forming a finger plate 540 extending away from the hinge 512. The external side wall 504 can be provided with an opening to accommodate a portion of the internal gate 510 in this configuration.

Operation of the debarker 500 can proceed similarly to operation of the debarker 100. The internal gate 510 can be rotated about the hinge 512 between a debarking configuration and an unloading configuration, as shown by arrows 514.

Figure 8:
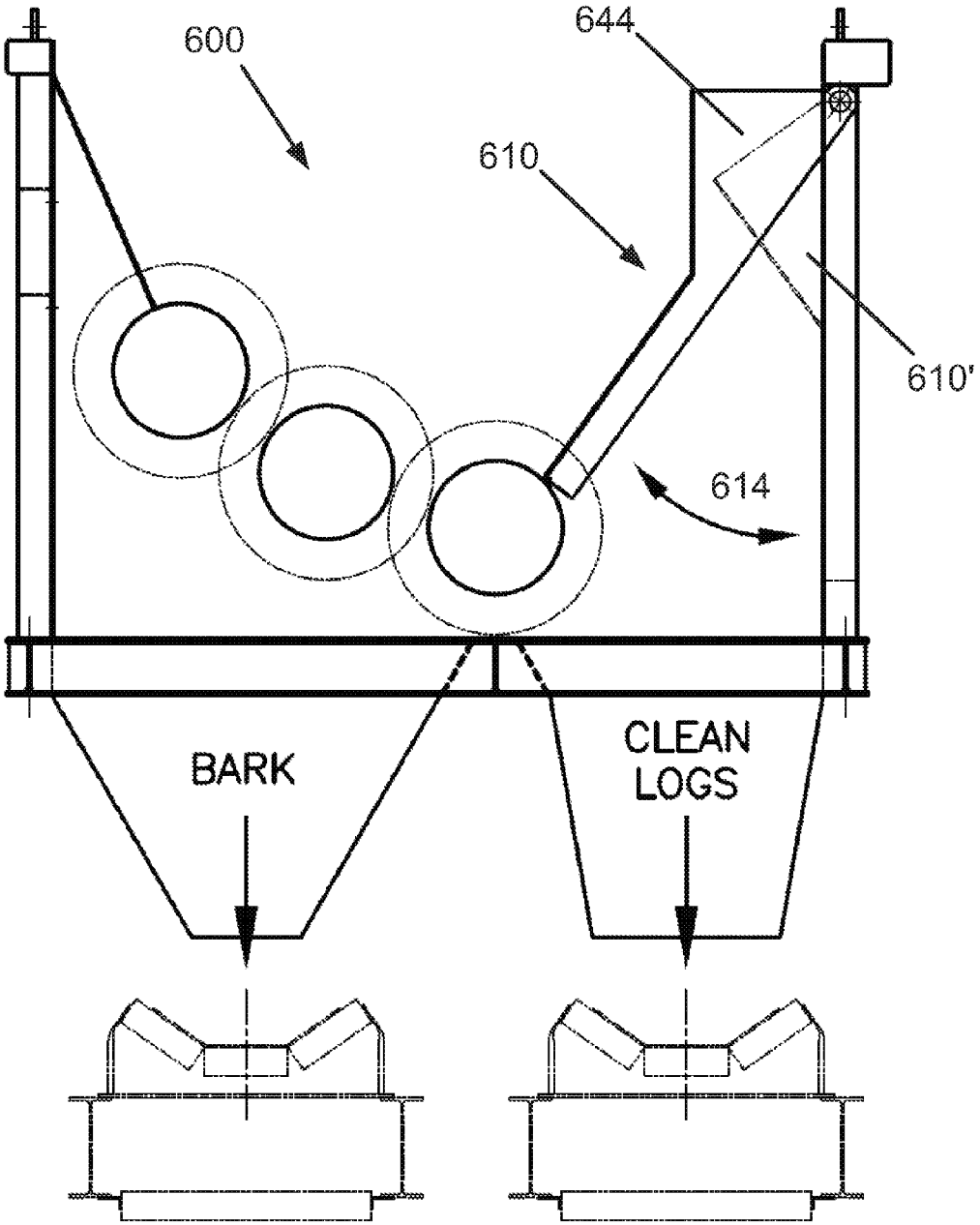
FIG. 8 illustrates a cross-sectional end view of another batch-style bottom-discharge rotary debarker according to at least one illustrated embodiment.

FIG. 8 illustrates another example of a batch-style bottom-discharge rotary debarker 600 similar to rotary debarker 100. Debarker 600 includes an internal gate 610 similar to internal gate 110. The internal gate 610 includes a triangular protrusion 644 at its top end portion. Operation of the debarker 600 can proceed similarly to operation of the debarker 100. The internal gate 610 can be rotated between a debarking configuration and an unloading configuration, as shown by arrow 614. The internal gate 610 and the triangular protrusion 644 can be configured such that when the internal gate 610 is in the debarking configuration, the top end portion of the internal gate 610 provides a vertical surface facing the interior of the bin and the rotors of the debarker 600.

Figure 9:
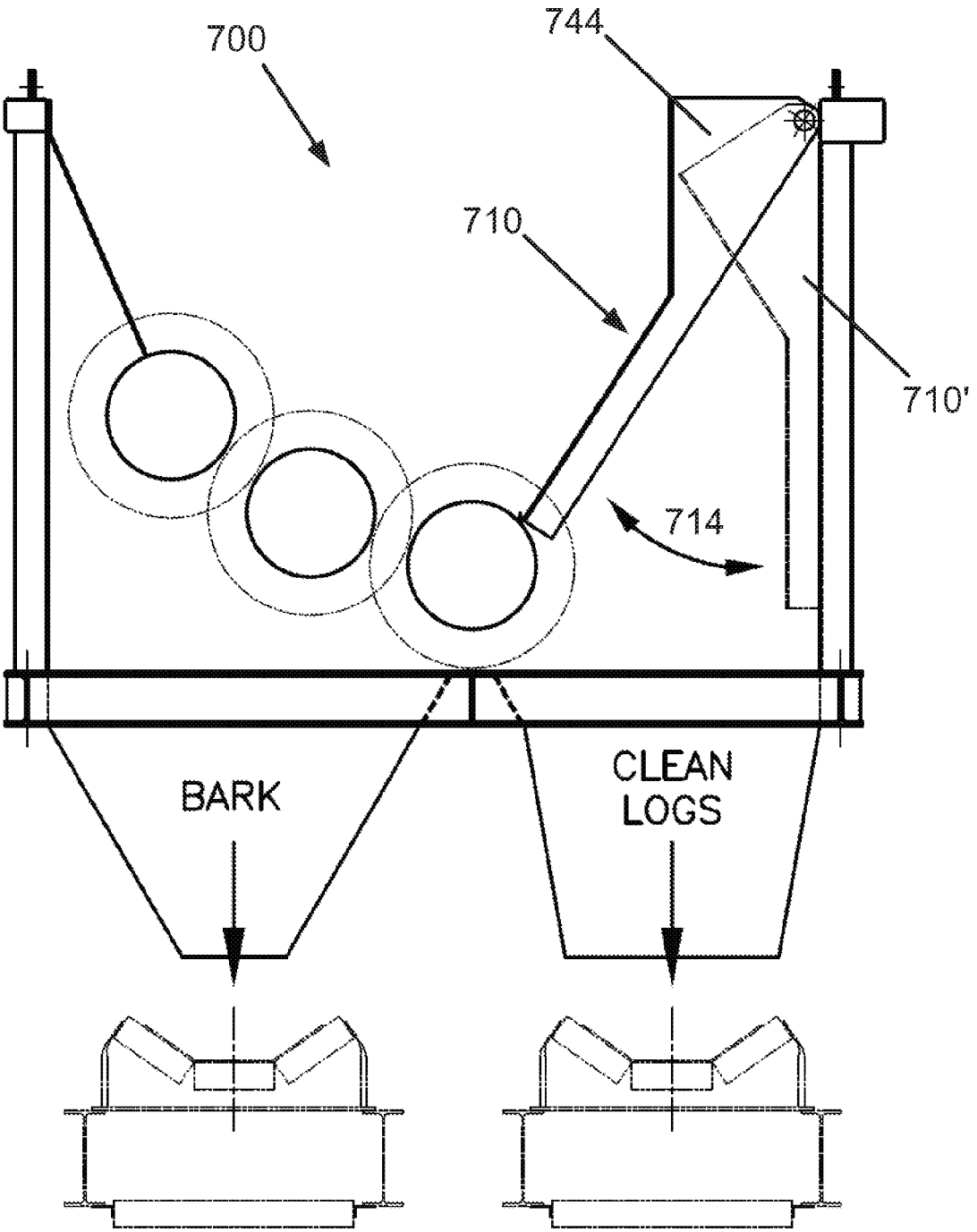
FIG. 9 illustrates a cross-sectional end view of another batch-style bottom-discharge rotary debarker according to at least one illustrated embodiment.

FIG. 9 illustrates another example of a batch-style bottom-discharge rotary debarker 700 similar to rotary debarker 200. Debarker 700 includes an internal gate 710 similar to internal gate 210. The internal gate 710 includes a triangular protrusion 744 at its top end portion. Operation of the debarker 700 can proceed similarly to operation of the debarker 200. The internal gate 710 can be rotated between a debarking configuration and an unloading configuration, as shown by arrow 714. The internal gate 710 and the triangular protrusion 744 can be configured such that when the internal gate 710 is in the debarking configuration, the top end portion of the internal gate 710 provides a vertical surface facing the interior of the bin and the rotors of the debarker 700.

Figure 10:
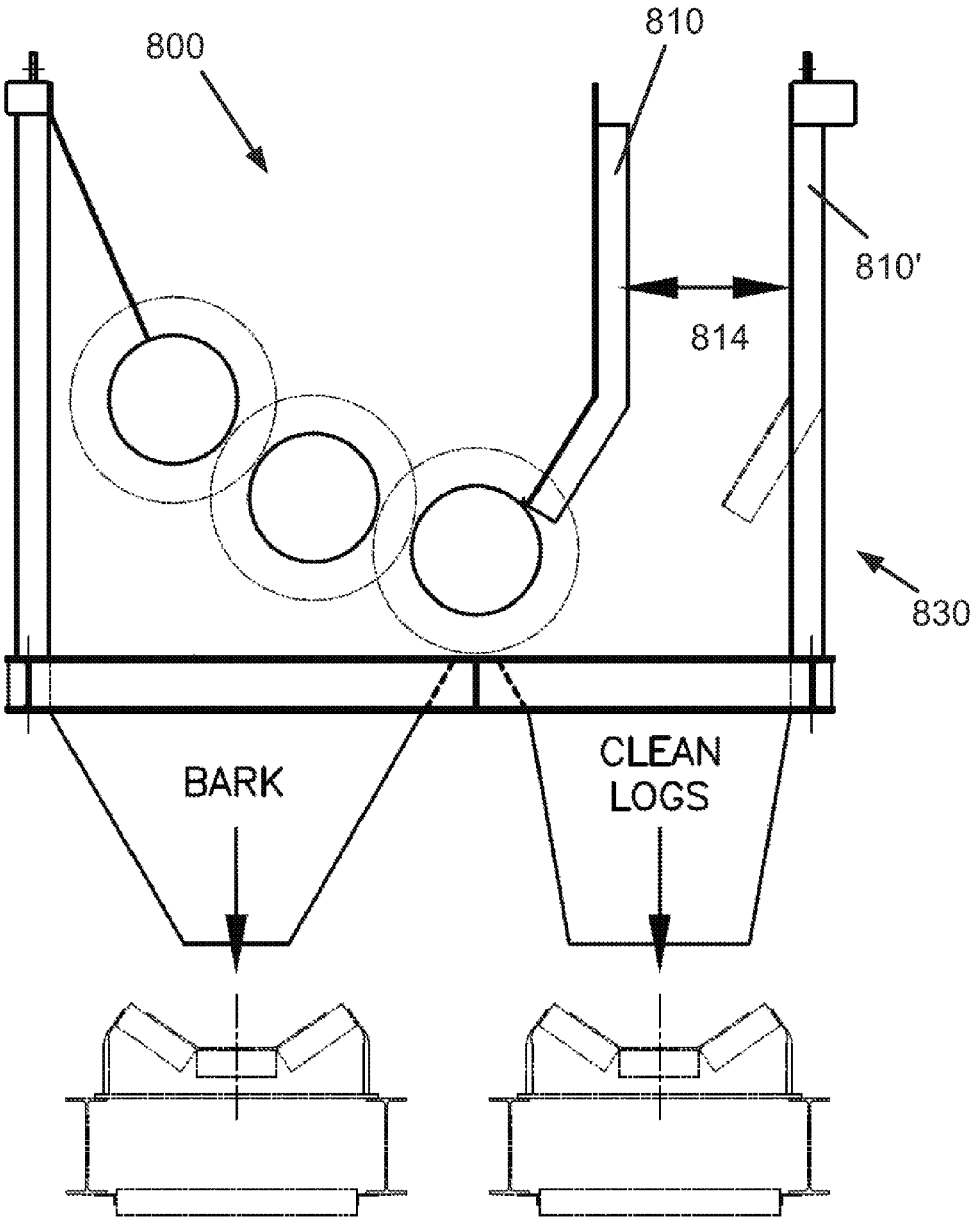
FIG. 10 illustrates a cross-sectional end view of another batch-style bottom-discharge rotary debarker according to at least one illustrated embodiment.

FIG. 10 illustrates another example of a batch-style bottom-discharge rotary debarker 800 similar to rotary debarker 100. Debarker 800 includes a bin 830 similar to bin 130 and a horizontally slidable, internal gate 810 coupled to end walls (not shown) of the bin 830. The internal gate 810 can slide horizontally with respect to the bin 830, such as along rails mounted to internal surfaces of the end walls of the bin 830. In this example, the internal gate 810 is angled or bent at a bend location at a middle portion of the internal gate 810 located between a top end portion and a bottom end portion of the internal gate 810. The internal gate 810 is angled or bent so as to form an angle less than 180° facing the interior of the bin 830 and the rotors of the debarker 800.

Operation of the debarker 800 can proceed similarly to operation of the debarker 100. The internal gate 810 can be moved with respect to the bin 830, such as by sliding horizontally, between a debarking configuration and an unloading configuration, as shown by arrow 814.

Figure 11:
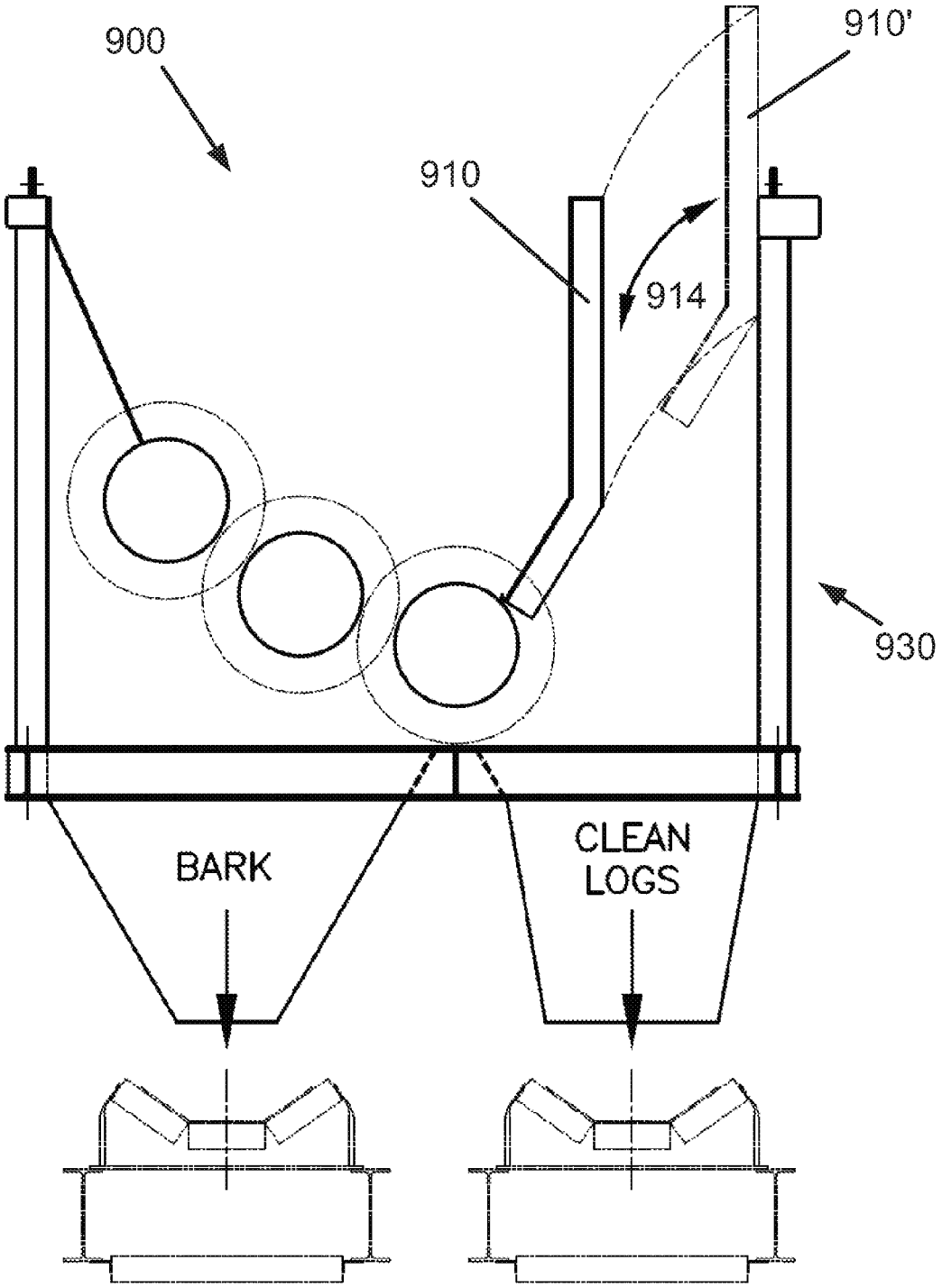
FIG. 11 illustrates a cross-sectional end view of another batch-style bottom-discharge rotary debarker according to at least one illustrated embodiment.

FIG. 11 illustrates another example of a batch-style bottom-discharge rotary debarker 900 similar to rotary debarker 100. Debarker 900 includes a bin 930 similar to bin 130 and a movable internal gate 910 coupled to end walls (not shown) of the bin 930. The internal gate 910 can move along a curved path with respect to the bin 930. For example, the internal gate 910 can be mounted on and move along curved rails mounted to internal surfaces of the end walls of the bin 930. As another example, the internal gate 910 can be mounted on a rotating structure mounted to the end walls of the bin 930. The rotating structure can rotate with respect to the bin 930 such that the internal gate 910 can follow a curved path as shown by arrow 914. In this example, the internal gate 910 is angled or bent at a bend location at a middle portion of the internal gate 910 located between a top end portion and a bottom end portion of the internal gate 910. The internal gate 910 is angled or bent so as to form an angle less than 180° facing the interior of the bin 930 and the rotors of the debarker 900.

Operation of the debarker 900 can proceed similarly to operation of the debarker 100. The internal gate 910 can be moved with respect to the bin 930, such as along the curved path shown by the arrow 914, in a generally clockwise direction between a lower debarking configuration and an upper unloading configuration.

Figure 12:
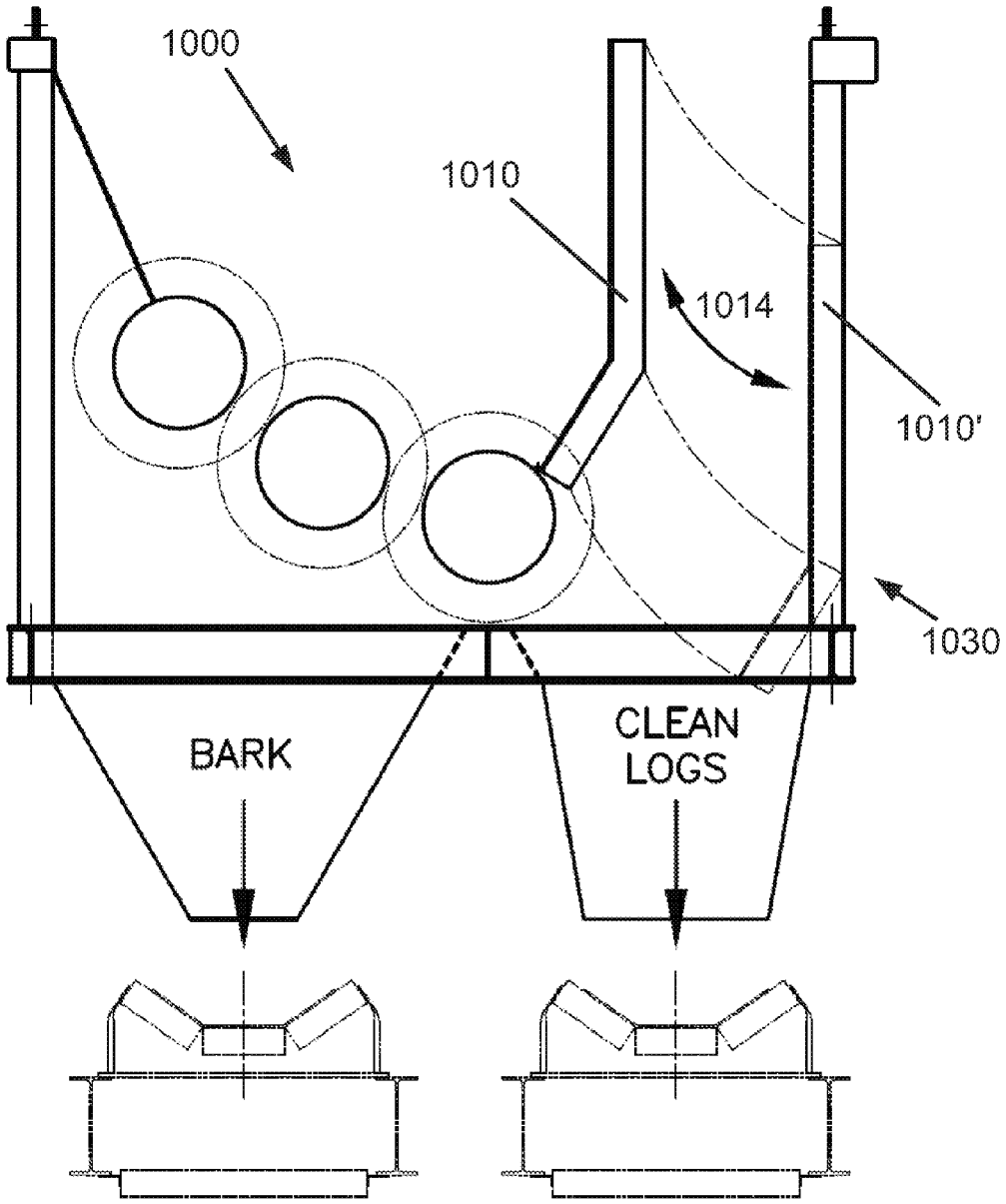
FIG. 12 illustrates a cross-sectional end view of another batch-style bottom-discharge rotary debarker according to at least one illustrated embodiment.

FIG. 12 illustrates another example of a batch-style bottom-discharge rotary debarker 1000 similar to rotary debarker 100. Debarker 1000 includes a bin 1030 similar to bin 130 and a movable internal gate 1010 coupled to end walls (not shown) of the bin 1030. The internal gate 1010 can move along a curved path with respect to the bin 1030. For example, the internal gate 1010 can be mounted on and move along curved rails mounted to internal surfaces of the end walls of the bin 1030. As another example, the internal gate 1010 can be mounted on a rotating structure mounted to the end walls of the bin 1030. The rotating structure can rotate with respect to the bin 1030 such that the internal gate 1010 can follow a curved path as shown by arrow 1014. In this example, the internal gate 1010 is angled or bent at a bend location at a middle portion of the internal gate 1010 located between a top end portion and a bottom end portion of the internal gate 1010. The internal gate 1010 is angled or bent so as to form an angle less than 180° facing the interior of the bin 1030 and the rotors of the debarker 1000.

Operation of the debarker 1000 can proceed similarly to operation of the debarker 100. The internal gate 1010 can be moved with respect to the bin 1030, such as along the curved path shown by the arrow 1014, in a generally counter-clockwise direction between an upper debarking configuration and a lower unloading configuration.

Figure 13:
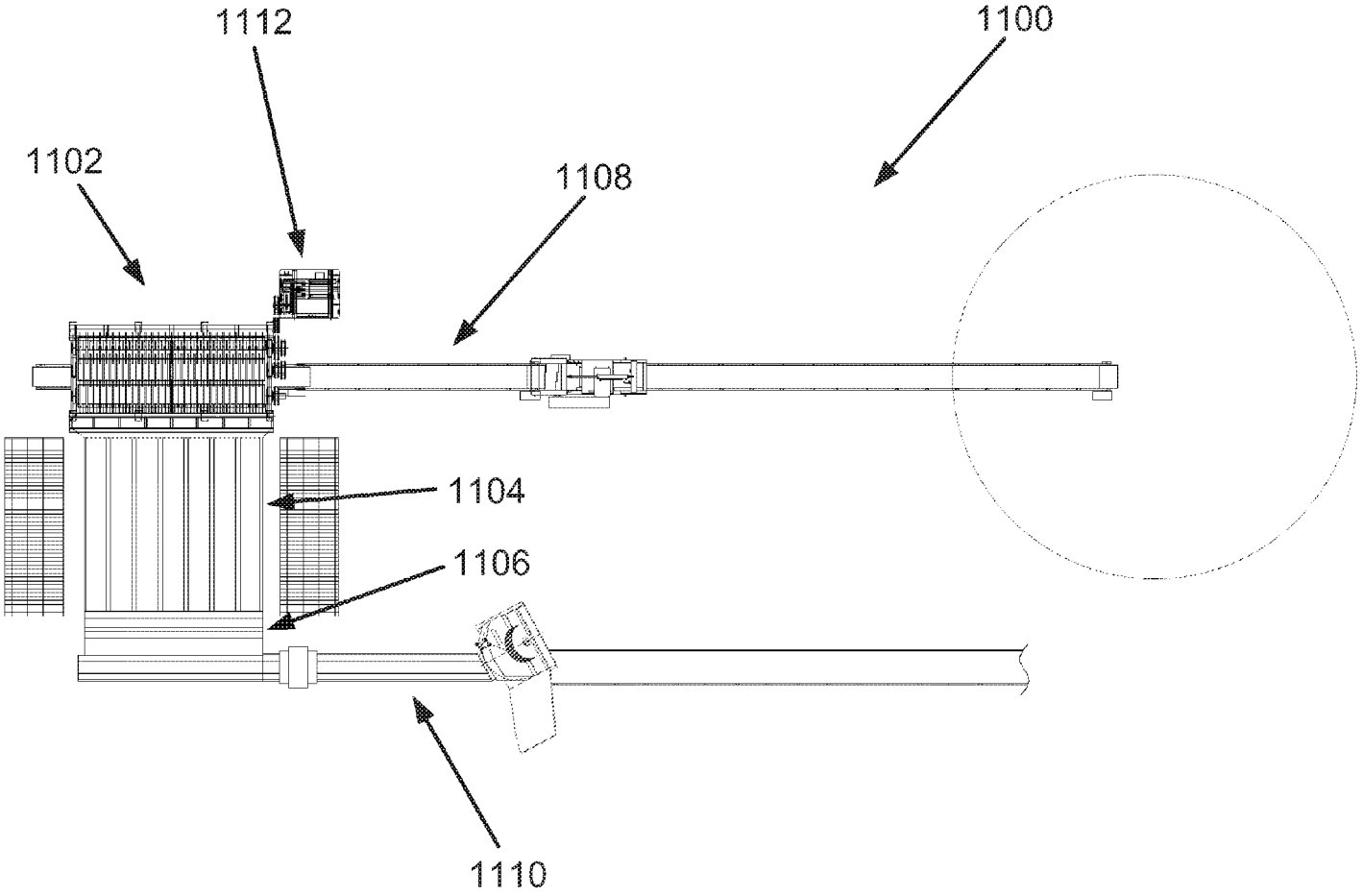
FIG. 13 illustrates a plan view of a debarking system according to at least one illustrated embodiment.
Figure 14:
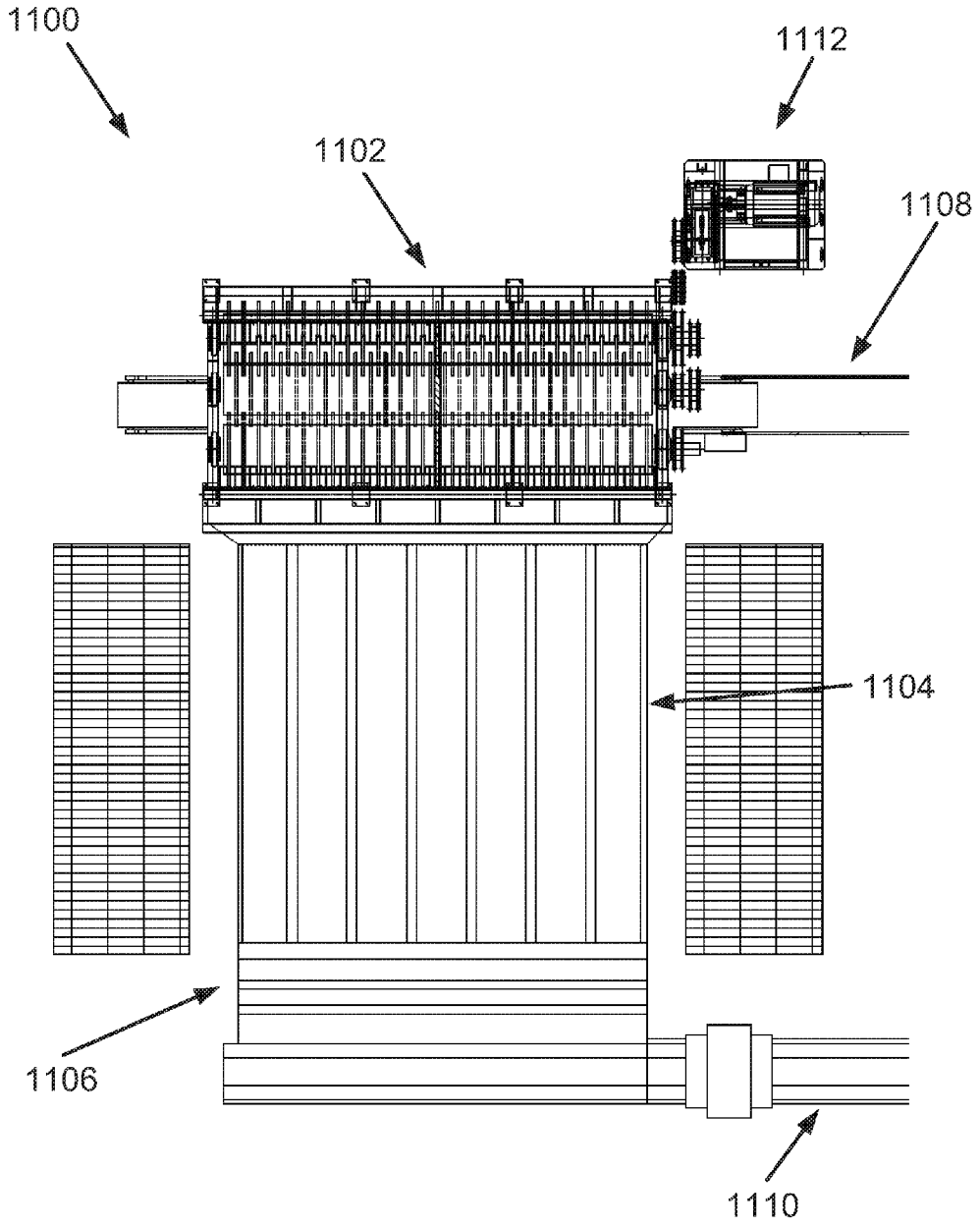
FIG. 14 illustrates another plan view of the debarking system of FIG. 13 according to at least one illustrated embodiment.

FIG. 13 illustrates a top plan view of a debarking system 1100. The debarking system 1100 includes a side-discharge debarking apparatus 1102, a transfer deck 1104, a singulator 1106, a bark conveyor 1108, a log conveyor 1110, and an engine 1112 for powering the components of the debarking system 1100. FIG. 14 illustrates another plan view at a larger scale of the debarking system 1100. The side-discharge debarking apparatus 1102 can be used to debark logs. Bark and other debris removed from the logs can fall out of the debarking apparatus 1102 and onto the bark conveyor 1108. Logs debarked within the debarking apparatus 1102 can be discharged from the side of the debarking apparatus 1102, such as onto the transfer deck 1104. The transfer deck 1104 can support debarked logs until they are singulated by the singulator 1106 and carried away by the log conveyor 1110.

Figure 15:
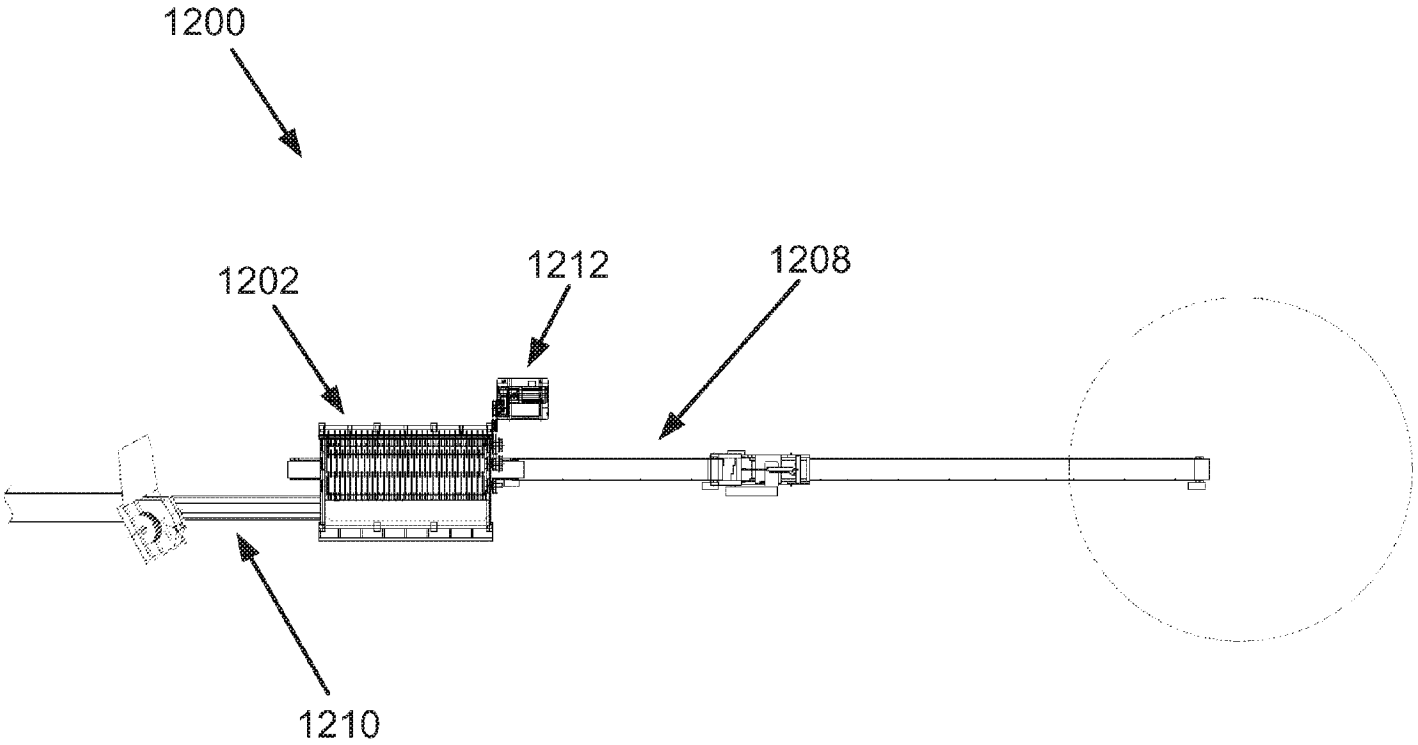
FIG. 15 illustrates a plan view of a debarking system according to at least one illustrated embodiment.
Figure 16:
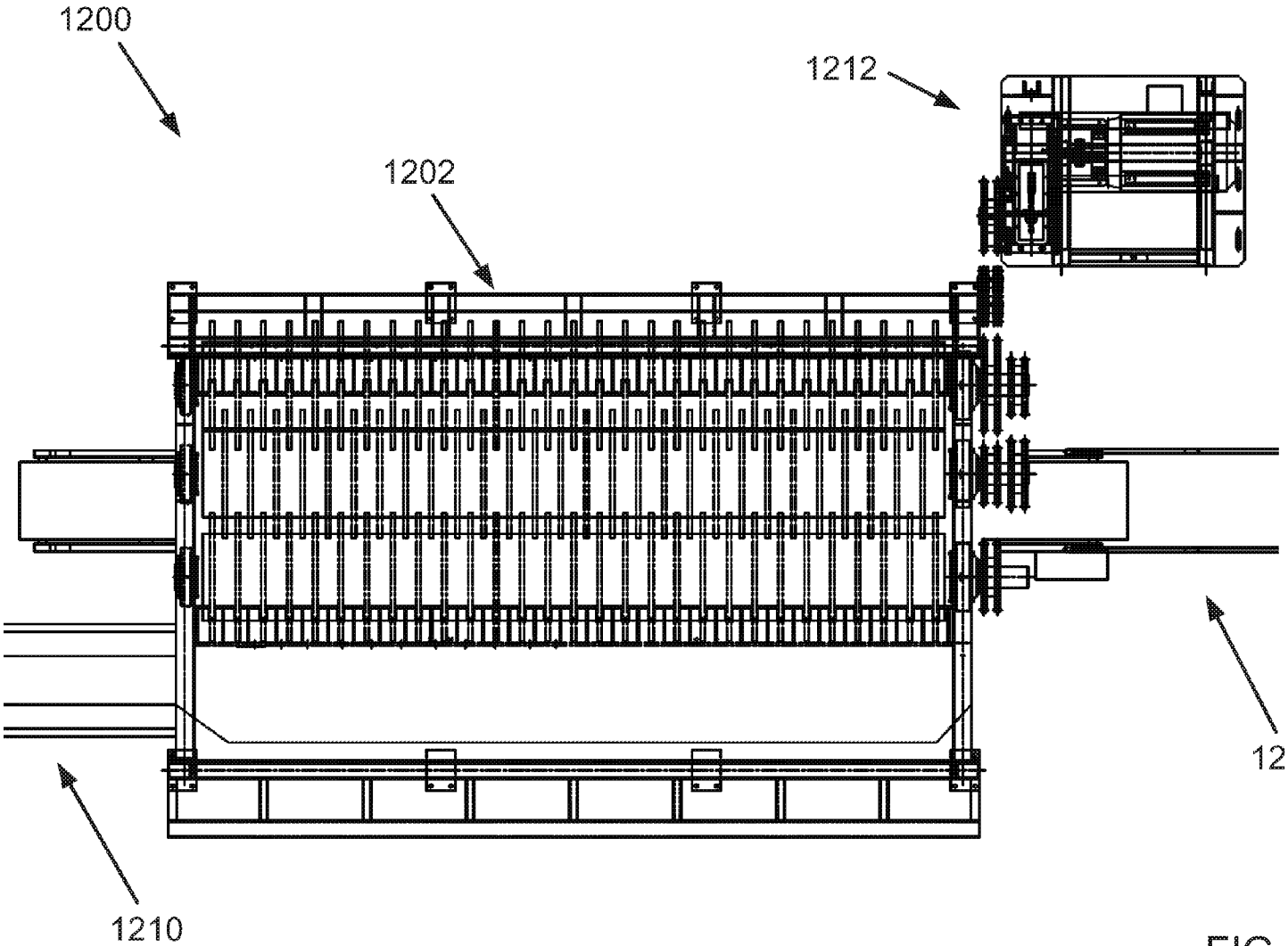
FIG. 16 illustrates another plan view of the debarking system of FIG. 15 according to at least one illustrated embodiment.

FIG. 15 illustrates a top plan view of a debarking system 1200. The debarking system 1200 includes a bottom-discharge debarking apparatus 1202, a bark conveyor 1208, a log conveyor 1210, and an engine 1212 for powering the components of the debarking system 1200. FIG. 16 illustrates another plan view at a larger scale of the debarking system 1200. The bottom-discharge debarking apparatus 1202 can be used to debark logs, as described above. Bark and other debris removed from the logs can fall out of the debarking apparatus 1202 and onto the bark conveyor 1208. Logs debarked within the debarking apparatus 1202 can be discharged from the bottom of the debarking apparatus 1202, such as directly onto the log conveyor 1210 to be carried away. As shown in FIG. 15, the bark conveyor 1208 can carry bark away from the debarking apparatus 1202 in a direction opposite to a direction in which the log conveyor 1210 carries logs away from the debarking apparatus 1202.

Thus, as seen by comparing FIGS. 13 and 14 with FIGS. 15 and 16, a bottom-discharge debarking apparatus can be more efficient than a side-discharge debarking apparatus, at least because it can reduce the need for a transfer deck and/or a singulator, which need not be provided for the bottom-discharge debarking apparatus. Further, a bottom-discharge debarking apparatus can take up less area than a side-discharge debarking apparatus, as both bark and debarked logs can fall out the bottom of the debarking apparatus directly onto respective conveyor belt systems.

Figure 17:
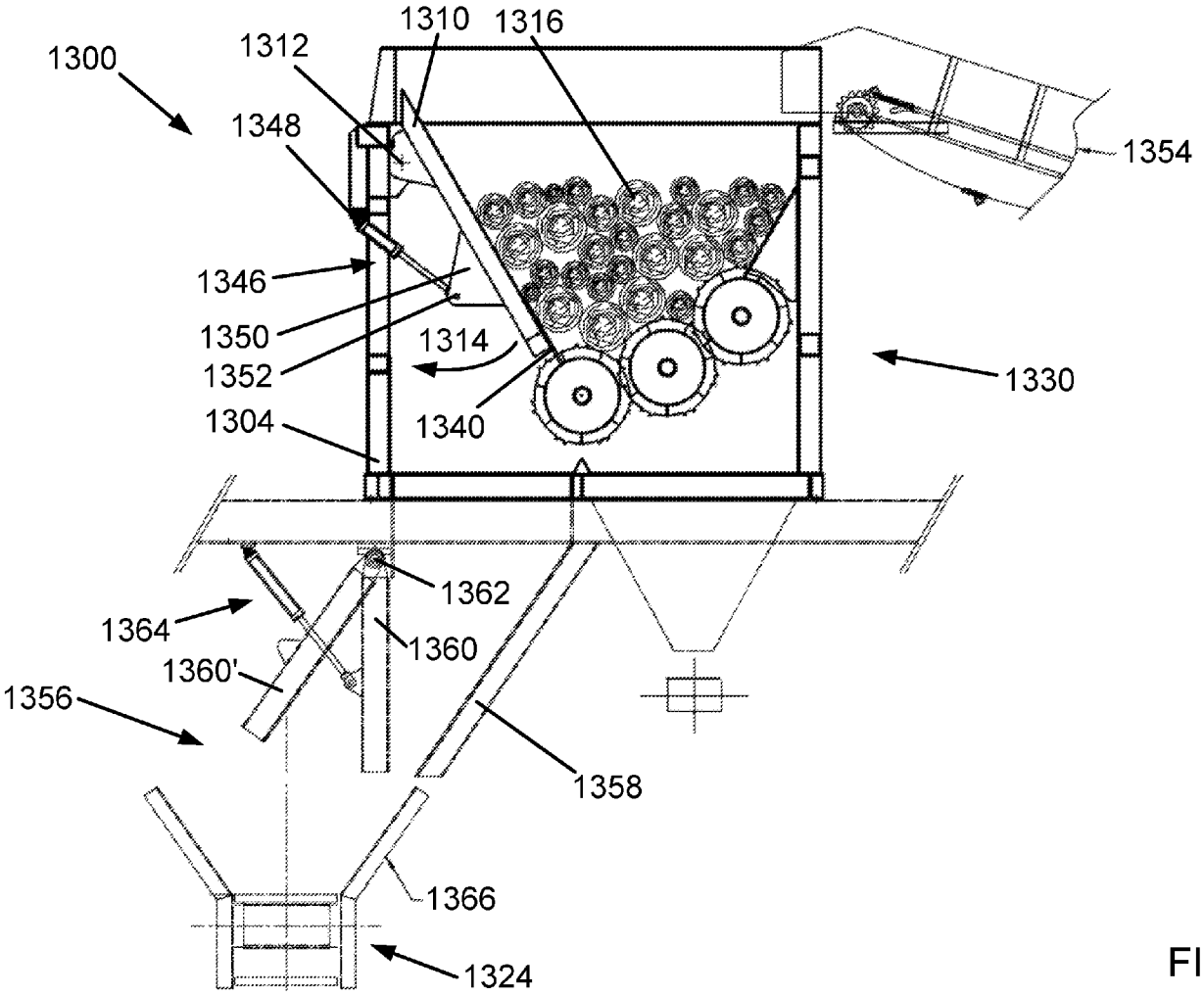
FIG. 17 illustrates a cross-sectional end view of another batch-style bottom-discharge rotary debarker during a log processing operation stage according to at least one illustrated embodiment.
Figure 18:
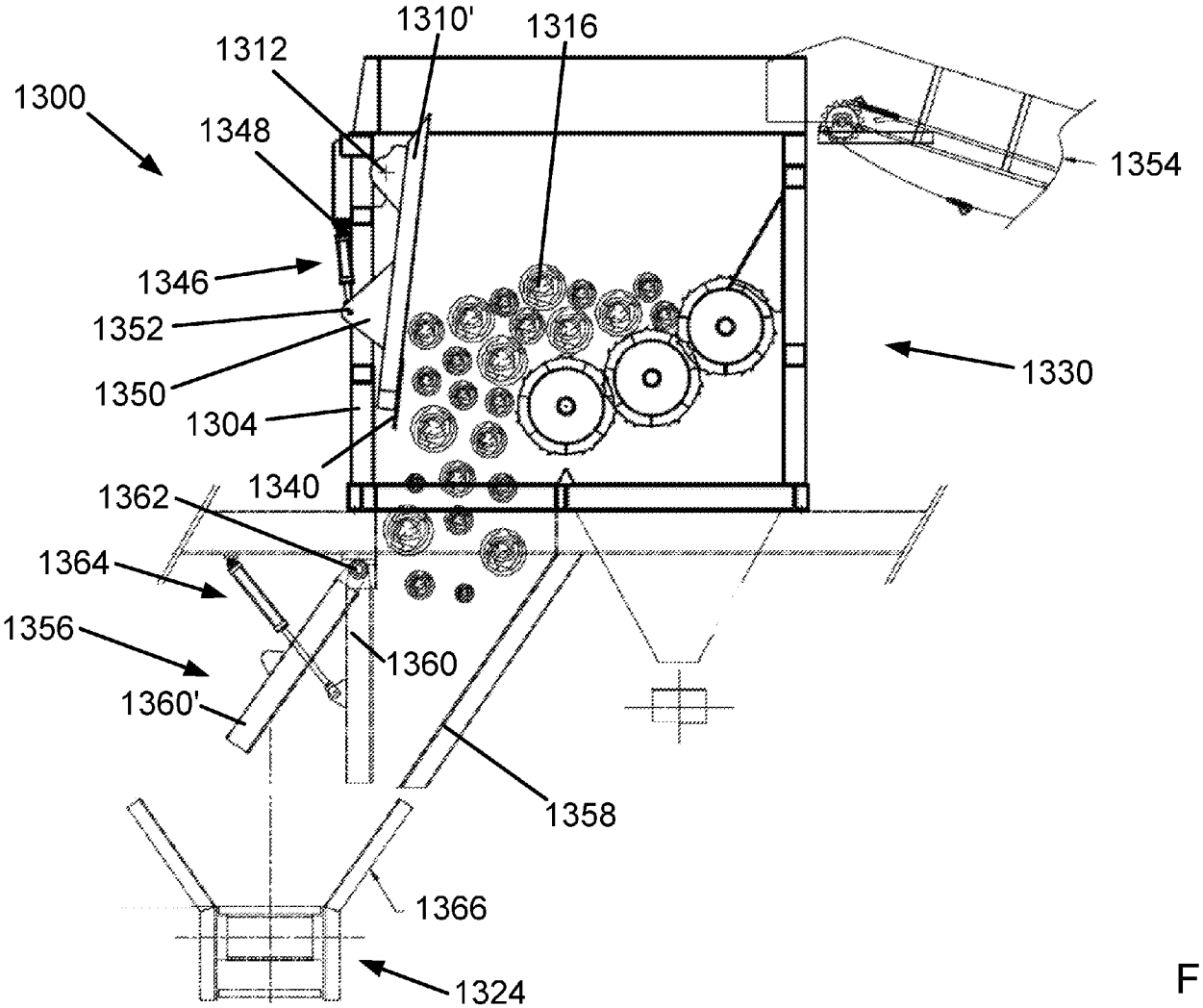
FIG. 18 illustrates a cross-sectional end view of the batch-style bottom-discharge rotary debarker of FIG. 17 during a log discharging operation stage according to at least one illustrated embodiment.
Figure 19:
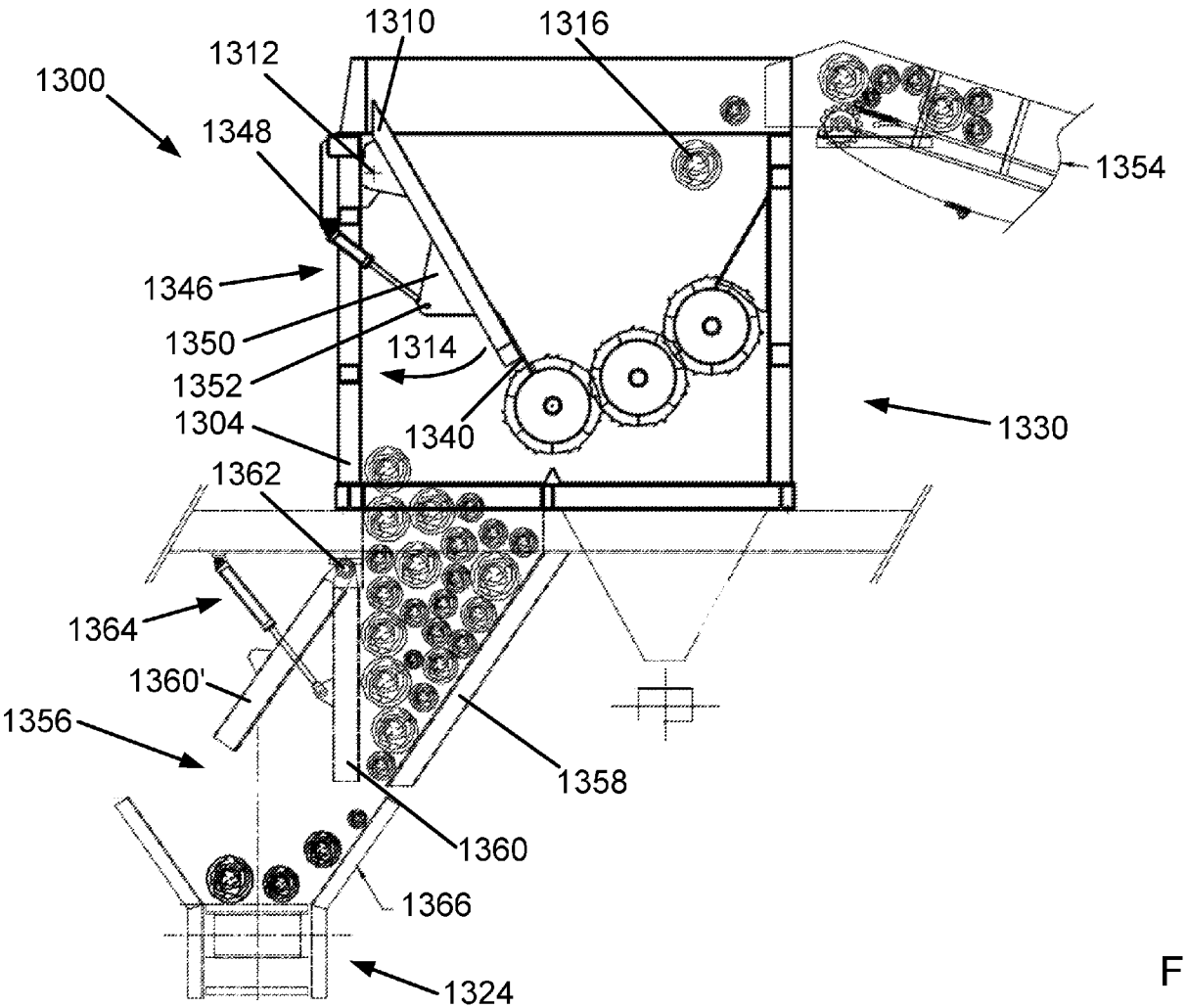
FIG. 19 illustrates a cross-sectional end view of the batch-style bottom-discharge rotary debarker of FIGS. 17-18 during a log feeding operation stage according to at least one illustrated embodiment.

FIGS. 17-19 illustrate end views of a debarking system 1300, which shares features with the debarking systems described above, during three different stages of its operation. In particular, FIG. 17 illustrates the debarking system 1300 during a log processing operation stage, FIG. 18 illustrates the debarking system 1300 during a log discharging operation stage, and FIG. 19 illustrates the debarking system 1300 during a log feeding operation stage.

Debarker 1300 includes a bin 1330 similar to bin 130 and an external side wall 1304 similar to the external side wall 104. Debarker 1300 also includes a rotatable, internal gate 1310 rotatably coupled to end walls (not shown) of the bin 1330 and/or to an interior surface of the external side wall 1304. The internal gate 1310 can rotate with respect to the external side wall 1304, such as at a hinge 1312 located adjacent to and coupled to a top end portion of the external side wall 1304. In this example, a top end portion of the internal gate 1310 is rotatably coupled to a top end portion of the external side wall 1304. Further, a bottom end portion of the internal gate 1310, i.e., the portion of the internal gate 1310 farthest from the hinge 1312 and opposite the top end portion of the internal gate 1310, can include a plurality of fingers forming a finger plate 1340 extending away from the hinge 1312.

The debarker 1300 includes a triangular mounting element 1350 coupled to the gate 1310 on a surface of the gate 1310 opposite the location of the logs 1316. The debarker 1300 also includes an actuator 1346, which can be a pneumatic or hydraulic cylinder 1346 rotatably coupled to the wall 1304 at a first hinge 1348 and rotatably coupled to the mounting element 1350 (and thereby to the gate 1310) at a second hinge 1352. The actuator 1346 can allow an operator to control movement of the gate 1310 within the bin 1330. For example, by increasing a pressure within the actuator 1346, the operator can move the gate 1310 to the debarking configuration shown in FIGS. 17 and 19, and by decreasing the pressure within the actuator 1346, the operator can move the gate 1310 to the unloading configuration shown in FIG. 18. The debarker 1300 also includes a log infeed conveyor belt 1354 that can carry the logs 1316 from another location into the bin 1330.

The debarker 1300 also includes a metering system 1356 that includes a metering ramp 1358, a metering gate 1360 rotatable about a metering hinge 1362 from a closed position 1360 to an open position 1360'. The metering system 1356 also includes a metering actuator 1364, which can be a pneumatic or hydraulic metering cylinder 1364, coupled to the gate 1360 to control movement of the gate 1360 between the closed position 1360 and the open position 1360'. The debarker 1300 also includes a trough 1366 to guide the logs 1316 from the metering system 1356 onto the conveyor 1324. The metering system 1356 can take the place of the log chute 120. That is, the metering system 1356 can be positioned underneath the bin 1330 and above the conveyor belt system 1324 such that logs can fall out of the bin 1330 into the metering system 1356 and out of the metering system 1356 onto the conveyor belt system 1324.

Operation of the debarker 1300 can proceed similarly to operation of the debarker 100. The internal gate 1310 can be rotated about the hinge 1312 between a debarking configuration and an unloading configuration, as shown by arrow 1314. Specifically, a method of operating the debarker 1300 can include using the actuator 1346 to move the internal gate 1310 to the debarking configuration and processing (e.g., debarking) the logs 1316 within the bin 1330, as shown in the log processing configuration of FIG. 17. The method can also include discharging the logs 1316 from within the bin 1330, so they fall into the metering system 1356, as shown in the log discharging configuration of FIG. 18. The method can also include using the actuator 1364 to move the gate 1360 to the open position 1360', thereby feeding the logs 1316 so they fall from the metering system 1356 onto a log conveyor belt system 1324, as shown in the log feeding configuration of FIG. 19.

The actuator 1364 can be used to control the size of a space or gap between the gate 1360 and the ramp 1358. For example, the actuator 1364 can be used to increase the size of such a gap to increase the rate at which the logs 1316 are fed onto the conveyor belt system 1324, or the actuator 1364 can be used to decrease the size of such a gap to decrease the rate at which the logs 1316 are fed onto the conveyor belt system 1324. This can be referred to as "metering" the feed rate of the logs 1316 onto the conveyor belt system 1324. As shown in FIG. 19, while the logs 1316 are being fed onto the conveyor belt system 1324, a new batch of logs 1316 can be fed into the bin 1330 to be debarked in a subsequent step.

Any of the debarking systems described herein can include one or more motors to drive the rotors. For example, a debarker can include a single motor to drive all of the rotors in the debarker. As another example, a debarker can include multiple motors, such as one motor for each rotor, to increase the total power available to drive the rotors. In some cases, the rotors can be rotationally locked to one another (e.g., such that they are constrained to rotate at the same speed), such as by a chain or interlocking features of the rotors. For example, the rotors of a debarker can be rotationally locked to one another and a single motor can be used to drive all of the rotors. As another example, the rotors of a debarker can be rotationally locked to one another and a single motor can be used to drive each of the rotors.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet, including U.S. provisional patent applications No. 62/153,390, filed Apr. 27, 2015, and No. 62/107,965, filed Jan. 26, 2015, are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A debarking system, comprising:

a bin including a first side wall, a first end wall, a second side wall opposite the first side wall, a second end wall opposite the first end wall, and an opening in a bottom of the bin;

a plurality of rotors, each of the plurality of rotors aligned with the first side wall, aligned with the second side wall, and spanning from the first end wall to the second end wall; and an internal gate movable from a debarking configuration, in which the internal gate obstructs access to the opening to prevent a log in the bin from falling out of the bin through the opening, to an unloading configuration, in which the internal gate is spaced apart from the debarking configuration to provide access to the opening and to allow the log to fall out of the bin through the opening.

2. The debarking system of claim 1 wherein the internal gate is rotatable about a top end portion of the second side wall to move from the debarking configuration to the unloading configuration.

3. The debarking system of claim 2 wherein the plurality of rotors forms a floor of the bin that is inclined downward from the first side wall toward the second side wall.

4. The debarking system of claim 3, further comprising:

a bark chute to guide bark falling between the plurality of rotors onto a first conveyor belt system; and a log chute to guide logs falling out of the bin onto a second conveyor belt system.

5. The debarking system of claim 4 wherein a bottommost one of the plurality of rotors is positioned directly above a location where an edge of the bark chute meets an edge of the log chute.

6. The debarking system of claim 1, further comprising a conveyor belt system and a metering system positioned underneath the bin to meter logs falling out of the bin through the opening onto the conveyor belt system.

7. The debarking system of claim 6 wherein the metering system includes a ramp and a gate rotatable with respect to the ramp between a closed position and an open position.

8. A debarking system, comprising:

a bin including a first side wall, a first end wall, a second side wall opposite the first side wall, a second end wall opposite the first end wall, and an opening in a bottom of the bin;

a plurality of rotors, each of the plurality of rotors aligned with the first side wall, aligned with the second side wall, and spanning from the first end wall to the second end wall;

a bark chute having an upper opening directly under the plurality of rotors and a lower opening directly over a first conveyor belt system;

a log chute having an upper opening directly under a gap between the plurality of rotors and the first side wall, and a lower opening directly over a second conveyor belt system; and an internal gate rotatable from a debarking configuration, in which the internal gate prevents a log in the bin from falling into the log chute, to an unloading configuration, in which the internal gate allows the log to fall into the log chute.

9. A method of debarking a log comprising:

depositing a plurality of logs into a bin;

actuating a plurality of rotors to rotate within the bin;

rotating an internal gate within the bin from a debarking configuration toward an unloading configuration; and allowing the logs to fall vertically out of the bin through an opening in a bottom of the bin.

10. The method of claim 9 wherein the plurality of rotors forms an inclined floor of the bin and actuating the plurality of rotors to rotate causes the plurality of logs to be carried upwards along the inclined floor.

11. The method of claim 9 wherein the plurality of rotors forms an inclined floor of the bin and actuating the plurality of rotors to rotate causes the plurality of logs to be carried downwards along the inclined floor.

12. The method of claim 9 wherein rotating the internal gate toward the unloading configuration comprises rotating the internal gate partially toward the unloading configuration to meter the logs falling vertically out of the bin.

13. The method of claim 9, further comprising allowing bark removed from the plurality of logs to fall between the plurality of rotors onto a first conveyor belt system.

14. The method of claim 13 wherein allowing the logs to fall vertically out of the bin comprises allowing the logs to fall onto a second conveyor belt system.

15. The method of claim 9 wherein allowing the logs to fall vertically out of the bin comprises allowing the logs to fall onto a conveyor belt system.

* * * * *